US006168146B1

(12) United States Patent
Komuro et al.

(10) Patent No.: US 6,168,146 B1
(45) Date of Patent: Jan. 2, 2001

(54) SHEET FEEDING APPARATUS AND SHEET PROCESSING APPARATUS

(75) Inventors: Hiroshi Komuro; Kazuhide Sugiyama; Minoru Sashida; Katsuhiko Okitsu, all of Chichibu (JP)

(73) Assignee: Canon Denshi Kabushiki Kaisha, Tokyo (JP)

( * ) Notice: Under 35 U.S.C. 154(b), the term of this patent shall be extended for 0 days.

(21) Appl. No.: 09/267,706

(22) Filed: Mar. 15, 1999

(30) Foreign Application Priority Data

Mar. 18, 1998 (JP) ..... 10-089214
Mar. 18, 1998 (JP) ..... 10-089483

(51) Int. Cl.[7] ..... B65H 5/00

(52) U.S. Cl. ..... 271/10.12; 271/122; 271/125; 271/242

(58) Field of Search ..... 271/10.11, 10.12, 271/10.13, 117, 119, 122, 124, 125, 242

(56) References Cited

U.S. PATENT DOCUMENTS

| | | | | |
|---|---|---|---|---|
| 4,858,905 | * | 8/1989 | Weigel | 271/122 |
| 5,443,359 | | 8/1995 | Miller et al. | 414/798.9 |
| 5,678,817 | | 10/1997 | Saito et al. | 271/122 |

FOREIGN PATENT DOCUMENTS

| | | | | |
|---|---|---|---|---|
| 0 591 526 | | 4/1994 | (EP) . | |
| 0111337 | * | 8/1980 | (JP) | 271/125 |
| 404333432A | * | 11/1992 | (JP) | 271/10.11 |
| 405147772A | * | 6/1993 | (JP) | 271/10.12 |
| 7-315606 | | 12/1995 | (JP) . | |

OTHER PUBLICATIONS

European Search Report.

* cited by examiner

*Primary Examiner*—H. Grant Skaggs
(74) *Attorney, Agent, or Firm*—Fitzpatrick, Cella, Harper & Scinto

(57) ABSTRACT

A sheet feeding apparatus has a pair of feeding roller and separating roller an inter-shaft distance changing mechanism for the pair of rollers, and sheet detecting means, and a sheet fed is rammed against the surface on which the feeding roller and the separating roller overlap each other to thereby correct skew feeding, and the feeding roller and the separating roller are moved away from each other to thereby feed the sheet. When the passage of the fed sheet between the feeding roller and the separating roller is detected the feeding roller and the separating roller assume a state in which sheet feeding is impossible. By the above-described operation being performed for each sheet, the correction of skew feeding and the separation of a sheet are effected by the feeding roller and the separating roller.

25 Claims, 12 Drawing Sheets

SHEET FEEDING APPARATUS AND SHEET PROCESSING APPARATUS

BACKGROUND OF THE INVENTION

1. Field of the Invention

This invention relates to a sheet feeding apparatus for feeding and conveying sheets (paper leaves such as originals, transfer paper, photosensitive paper, electrostatic recording paper, thermosensitive paper, printing paper, OHP sheets, envelopes and postcards) such as cards and thin paper leaves piled in various sheet-using apparatuses such as image forming apparatuses including rotary type cameras, facsimile apparatuses, printing machines, copying machines, printers, word processors, etc. and other apparatuses such as automatic original feeding apparatuses, punching machines and paper binding machines one by one to a sheet processing portion such as an image forming portion, an exposure portion and a processing portion.

2. Related Background Art

As one of the sheet separating mechanisms of sheet feeding apparatus for separating and conveying piled sheets one by one, there is known a mechanism using a pair of comb-toothed rollers.

This mechanism is such that two comb-toothed rollers formed with comb-tooth-like grooves in the outer peripheral portion thereof are disposed in opposed relationship with each other substantially in parallelism to each other with the concave surfaces and convex surfaces of their grooves axially overlapping each other in non-contact with each other, and one of the two rollers is used as a feeding roller and the frictional force thereof with respect to a sheet is made great and the other roller is used as a separating roller and the frictional force thereof with respect to the sheet is made smaller than that of the feeding roller. The feeding roller is rotated in a forward feeding direction and the separating roller is rotated in a reverse feeding direction, and the sheet is fed to the nip portion between this pair of rollers. Thereby, even if a plurality of sheets are fed in overlapping relationship with one another, only the sheet which is in contact with the feeding roller is passed through the nip portion by the feeding force of the feeding roller rotated in the forward feeding direction, irrespective of the separating roller rotated in the reverse feeding direction, and the other sheets are reversely conveyed by the separating roller rotated in the reverse feeding direction and is prevented from coming into or being passed through the nip portion, whereby only that sheet which is in contact with the feeding roller is separated and conveyed.

There is also known a mechanism in which when sheets are separated and conveyed one by one, a movable guide plate provided at one side or both sides of the sheet to prevent skew feeding is moved and the side portion of a skew-fed sheet is pushed against the guide plate to thereby correct skew feeding, or a mechanism in which the skew feeding of a sheet being fed is detected by the use of a sensor and as required, a conveying roller is rotatively driven by an amount corresponding to the skew feeding to thereby forcibly effect correction.

FIG. 13A schematically shows the construction of a sheet feeding apparatus using a pair of comb-toothed rollers as a sheet separating mechanism.

sheets 200 are piled and set in a predetermined manner on a sheet supply tray 1. This sheet supply tray 1 is vertically controlled to a sheet supply position indicated by solid line and a standby position indicated by dots-and-dash line.

An upper guide plate 2 and a lower guide plate 3 together constitute a sheet conveying path. The sheet supply tray side of the lower guide plate 3 is downwardly bent forwardly of the fore end of the sheet supply tray 1 to provide a sheet leading end ramming plate portion 3*a* for uniformizing the position of the leading end surface of the sheets piled on the sheet supply tray 1.

A sheet feeding roller 4 picks up and feeds the sheets 200 piled and set on the sheet supply tray 1.

A pair of feeding roller and separating roller 5 and 6 are disposed downstream of the sheet feeding roller 4 with respect to the direction of sheet conveyance. The feeding roller 5 is an upper roller and the separating roller 6 is a lower roller.

The feeding roller 5 and the separating roller 6, as shown in the perspective view of FIG. 13B, are such that comb-toothed rollers formed with comb-tooth-like grooves in the outer peripheral portions thereof are disposed in opposed relationship with each other substantially in parallelism to each other with the concave surfaces and convex surfaces of the grooves thereof axially overlapping each other in non-contact with each other. The frictional force of the feeding roller 5 with respect to the sheet is made greater than the frictional force of the separating roller 6 with respect to the sheet.

Registration rollers 16 and conveying rollers 17 are successively disposed downstream of the pair of feeding roller and separating roller 5 and 6 with respect to the direction of sheet conveyance.

The sheet feeding roller 4 receives the transmission of motive power from a first motor M1 through a pulley 12, a belt 11, a two-step pulley 10, a belt 8 and a pulley 4*a,* and is rotatively driven in the clockwise direction of arrow which is a forward feeding direction.

Of the feeding roller 5 and the separating roller 6, the feeding roller 5 receives the transmission of motive power from the first motor M1 through the pulley 12, the belt 11, the two-step pulley 10, a belt 9 and a pulley 5*a,* and is rotatively driven in the clockwise direction of arrow A which is the forward feeding direction.

Also, the separating roller 6 receives the transmission of motive power from a second motor M2 through a pulley 13, a belt 7 and a pulley 6*a,* and is rotatively driven at the nip portion with the feeding roller 5 in the clockwise direction of arrow B which is a reverse feeding direction.

Of the feeding roller 5 and the separating roller 6, the feeding roller 5 is disposed on a movable chassis 21 pivotally movable about the support shaft of the two-step pulley 10. The reference numeral 20 designates a shaft provided on the upper side of the movable chassis 21, and the reference character 20*a* denotes a cam follower provided on one end side of this shaft 20. The reference numeral 19 designates an eccentric cam, and the movable chassis 21 is counter-clockwisely biased about the support shaft of the two-step pulley 10 by a biasing spring member, not shown, so that the cam follower 20*a* may be normally in contact with the lower surface portion of the eccentric cam 19. The reference numeral 27 denotes an adjusting knob for rotatively operating the eccentric cam 19.

The above-described adjusting knob 27, eccentric cam 19, can follower 20*a,* shaft 20, movable chassis 21, etc. together constitute a mechanism for changing the distance between the shafts of the feeding roller 5 and the separating roller 6.

That is, by the adjusting knob 27 being turned, the cam 19 is rotated and the motion of the cam is transmitted to the feeding roller 5 through the cam follower 20*a,* the shaft 20 and the movable chassis 21, and the vertical position of the feeding roller 5 is displaced, and the distance between the shafts of the feeding roller 5 and the separating roller 6 can be changed more or less to thereby adjust the amount of entry or the amount of gap of the feeding roller 5 relative to the separating roller 6 in accordance with the thickness of the sheet.

Thus, during non-sheet feeding, the sheet supply tray 1 is lowered to its standby position indicated by dots-and-dash line, and is downwardly spaced apart from the sheet feeding roller 4. In this state, the sheets 200 are piled and set on the sheet supply tray 1. The sheets 200 are sufficiently inserted until the leading end thereof strikes against the ramming plate portion 3*a,* whereby the position of the leading end surface of the sheets piled on the sheet supply tray 1 is uniformized.

On the basis of a sheet feed starting signal, the sheet supply tray 1 is moved upwardly and as indicated by solid lines, the upper surface of the leading end side of the sheets 200 piled on the sheet supply tray 1 is held in contact with the lower surface of the sheet feeding roller 4.

Thereupon, the uppermost sheet 22 of the piled sheets 200 is fed out (picked up) by the rotating sheet feeding roller 4, and arrives at the nip portion between the feeding roller 5 and the separating roller 6 while being guided by the upper guide plate 2 and the lower guide plate 3 and enters the nip portion.

The uppermost sheet 22 which has entered the nip portion is conveyed through the nip portion by the feeding force of the feeding roller 5 rotated in the forward feeding direction, irrespective of the separating roller 6 rotated in the reverse feeding direction, because the frictional force of the feeding roller 5 with respect to the sheet is greater than that of the separating roller 6.

Also, even if a plurality of sheets 22, 22', are overlapping fed to the nip portion by the sheet feeding roller 4, only the sheet 22 of the double-fed sheets which is in contact with the feeding roller 5 passes through the nip portion by the feeding force of the feeding roller 5 rotated in the forward feeding direction, irrespective of the separating roller 6 rotated in the reverse feeding direction. The other sheets 22', . . . are reversely conveyed by the separating roller 6 rotated in the reverse feeding direction and is prevented from entering or passing through the nip portion and double feeding is thus prevented, whereby only the sheet 22 which is in contact with the feeding roller 5 is separated and conveyed.

The sheet 22 separated and conveyed by the pair of feeding roller and separating roller 5 and 6 passes the registration rollers 16 and the conveying rollers 17 and is fed to a sheet processing portion such as a reading portion, not shown. The registration rollers 16 determine the conveyance timing at which the sheet 22 is conveyed to the sheet processing portion, in conformity with the instructions from a control portion (CPU), not shown, and effect the conveyance of the sheet.

When sheets of different thicknesses are to be fed, the adjusting knob 27 is rotatively operated to thereby change the amount of entry or the amount of gap of the feeding roller 5 relative to the separating roller 6 at the nip portion between the feeding roller 5 and the separating roller 6, and set it to a predetermined sheet thickness. That is, the rotated position of the cam 19 connected to the adjusting knob 27 is changed, whereby the shaft 20 in contact with the cam 19 and the movable chassis 21 connected to the shaft 20 are moved to change the distance between the shafts of the feeding roller 5 and the separating roller 6, whereby said setting is effected and even sheets of different thicknesses can be conveyed while avoiding double feeding.

In the case of the above-described sheet separating mechanism, the distance between the shafts of the pair of comb-toothed rollers which are the feeding roller and the separating roller is adjustable so that normal separation may be done even if the thickness of the sheet changes.

However, there has been the problem that the above-mentioned adjustment must be manually effected to a proper position for each thickness of the sheets being fed and sheets of different thicknesses cannot be mixedly piled and processed.

Also, movable guide plates (not shown) provided at one side or both sides of the sheets are moved to prevent the skew feeding when the sheets are separated and conveyed one by one, and correction is effected with the side portions of the sheets rammed against the guide plates to prevent skew feeding.

Such a skew feeding correcting mechanism has been very cumbersome in that the positions of the guide plates must be changed when sheets of different widths are to be conveyed.

Also, a mechanism for detecting the skew feeding of a sheet being conveyed by the use of a sensor, and effecting rotative driving by an amount corresponding to the skew feeding by the use of a conveying roller as required to thereby forcibly correct the skew feeding has suffered from the disadvantage that the construction is complicated and sheets become wrinkled.

SUMMARY OF THE INVENTION

So, it is an object of the present invention to provide a sheet feeding apparatus which can automatically separate and convey sheets of different thicknesses by a simple construction and can also automatically correct the skew feeding of the sheets.

The present invention provides a sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between said two rotatable members, characterized by an inter-shaft distance changing mechanism for at least one of said two rotatable members to change the inter-shaft distance thereof relative to the other rotatable member, sheet detecting means provided near said two rotatable members for detecting the passage of the sheets, and means for controlling so that with the start of feeding, at least one of said two rotatable members may start the operation of spacing its inter-shaft distance relative to the other rotatable member, and when a sheet is detected by said sheet detecting means, the operation of spacing said inter-shaft distance may be stopped, and when the feeding of said sheet is completed, at least one of said two rotatable members may bring the inter-shaft distance thereof relative to the other rotatable member close to a position in which feeding is impossible.

Further, the present invention provides a sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between said two rotatable members, characterized by an inter-shaft distance changing mechanism for at least one of said two rotatable members to change the inter-shaft distance thereof relative to the other rotatable member, sheet detecting means provided near said two rotatable members for detecting the passage of the sheets, and means for controlling so that with the start of feeding, at least one of said two rotatable members may start the operation of spacing its inter-shaft distance relative to the other rotatable member, and may stop the operation of spacing said inter-shaft distance after it has performed the operation of spacing said inter-shaft distance by a predetermined amount from a point of time at which a sheet has been detected by said sheet detecting means, and when the feeding of said sheet is completed, at least one of said two rotatable members may perform the operation of bringing the inter-shaft distance thereof relative to the other rotatable member close to a position in which feeding is impossible, for each sheet fed.

The sheet feeding apparatus of the present invention is characterized in that said sheet feeding rotatable member and said sheet separating rotatable member are rollers, and the rotary shafts of said rollers are substantially parallel to each other and are formed with comb-tooth-like grooves on the outer peripheral portions thereof, and have a shape in which the concave surfaces and convex surfaces of the grooves are in non-contact with each other and cam overlap each other axially thereof.

Said sheet feeding rotatable member and said sheet separating rotatable member are in a state in which they hamper the feeding of the sheets before the feeding of the sheets is started or after the inter-shaft distance has been brought close.

Also, the present invention provides a sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between said two rotatable members, characterized by an inter-shaft distance changing mechanism for at least one of said two rotatable members to change the inter-shaft distance thereof relative to the other rotatable member, sheet detecting means provided downstream of the axially most proximate portions of said two rotatable members with respect to the direction of sheet conveyance, and means for controlling so that with the start of feeding, at least one of said two rotatable members may start the operation of spacing its inter-shaft distance relative to the other rotatable member, and when the passage of a sheet through the most proximate portions of said two rotatable members is detected by the ON of the sheet detection signal of said sheet detecting means, the operation of spacing said inter-shaft distance may be stopped, and the operation of at least one of said two rotatable members bringing the inter-shaft distance thereof relative to the other rotatable member close to a position in which feeding is impossible, on the basis of the OFF of the sheet detection signal of said sheet detecting means, may be performed for each sheet fed.

The present invention also provides a sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between said two rotatable members, characterized by an inter-shaft distance changing mechanism for at least one of said two rotatable members to change the inter-shaft distance thereof relative to the other rotatable member, sheet detecting means provided downstream of the axially most proximate portions of said two rotatable members with respect to the direction of sheet conveyance, and means for controlling so that with the start of feeding, at least one of said two rotatable members may start the operation of spacing its inter-shaft distance relative to the other rotatable member, and when the passage of a sheet through said most proximate portions is detected by the ON of the sheet detection signal of said sheet detecting means, the operation of spacing said inter-shaft distance may be stopped after the operation of spacing said inter-shaft distance by a predetermined amount has been performed from the point of time of the detection, and the operation of at least one of said two rotatable members bringing the inter-shaft distance relative to the other rotatable member close to a position in which sheet feeding is impossible, on the basis of the OFF of the sheet detection signal of said sheet detecting means, may be performed for each sheet fed.

The fed sheet is rammed against the opposed portion of the sheet feeding rotatable member and the sheet separating rotatable member to thereby correct skew feeding, and the sheet is fed by the operation of spacing the inter-shaft distance of said two rotatable members being performed. When the passage of the fed sheet between said two rotatable members is detected, said two rotatable members become incapable of feeding a sheet by the inter-shaft distance thereof being narrowed. The above-described operation is performed for each sheet, whereby the correction of skew feeding and the separation of a sheet are effected by the feeding roller and the separating roller.

Thus, the sheet feeding apparatus according to the present invention can feed sheets independently of the thicknesses of the sheets, and yet can avoid double feeding even if sheets of different thicknesses are mixed, and can feed the sheets accurately one by one.

Also, the end surface of a skew-fed sheet is rammed against the sheet feeding rotatable member and the sheet separating rotatable member overlapping axially thereof in non-contact with each other, whereby the correction of skew feeding can be effected.

Thus, it becomes unnecessary to manually adjust thickness for each thickness of sheets, and it also becomes unnecessary to detect the posture of the sheet being conveyed and correct the skew feeding thereof in the conveyance path.

As described above, the automatic separation of sheets and the correction of the skew feeding thereof can be effected by only the mechanism of the sheet feeding rotatable member and the sheet separating rotatable member and therefore, the apparatus itself becomes very compact and simple.

DESCRIPTION OF THE PREFERRED EMBODIMENTS

<First Embodiment>

(FIGS. 1 to 5)

Figure 1:
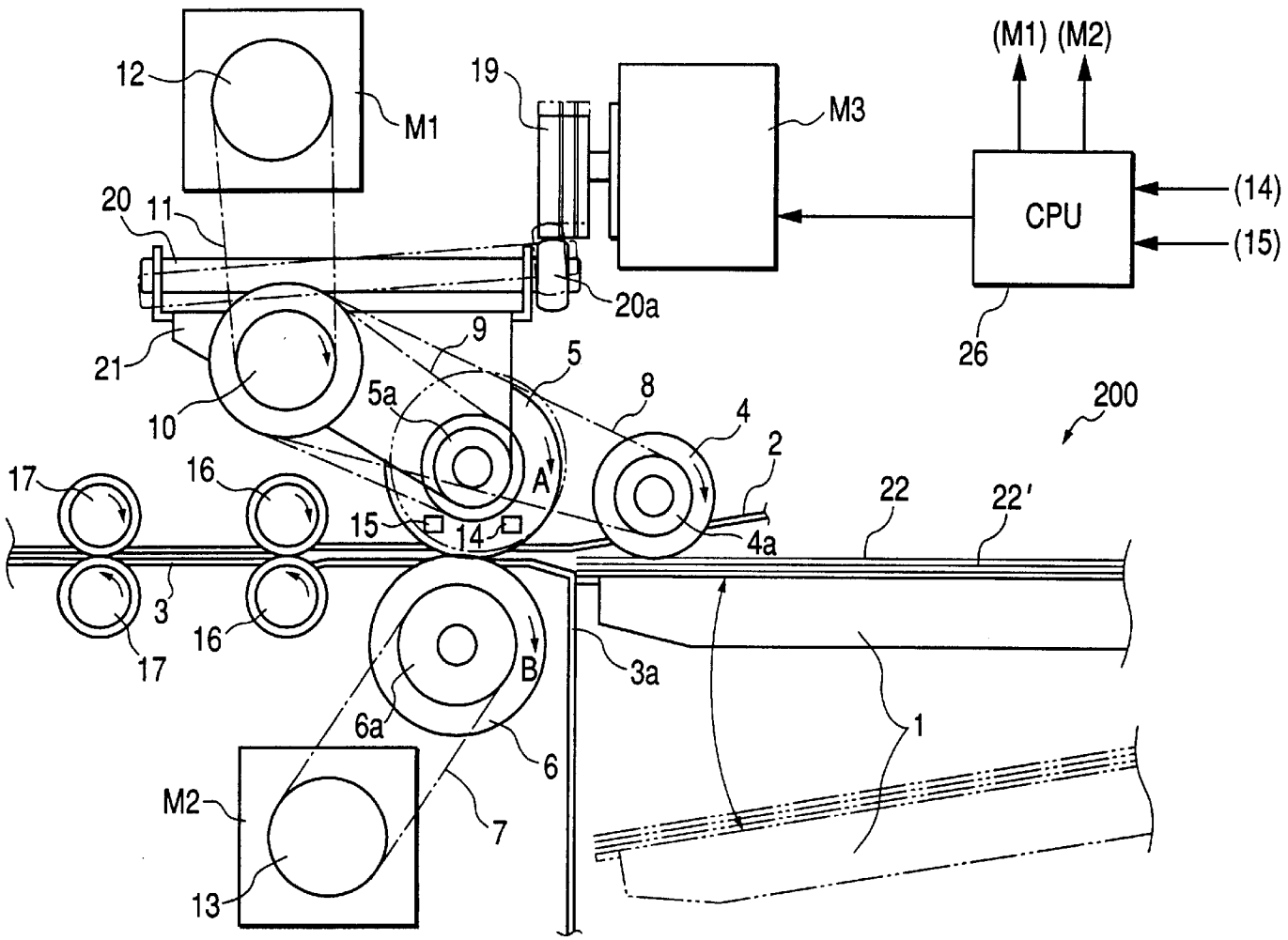
FIG. 1 schematically shows the construction of a sheet feeding apparatus according to a first embodiment of the present invention.
Figure 13B:
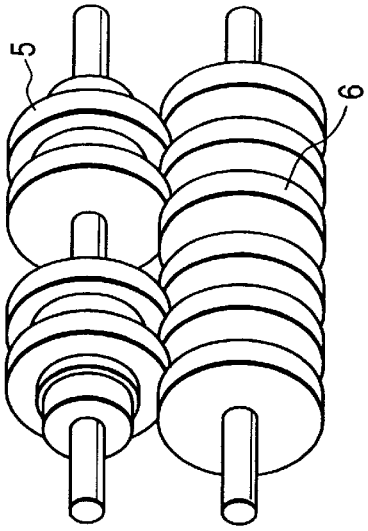
FIG. 13B PRIOR ART
FIGS. 13A and 13B schematically show the construction of a sheet feeding apparatus according to the prior art.
Figure 13A:
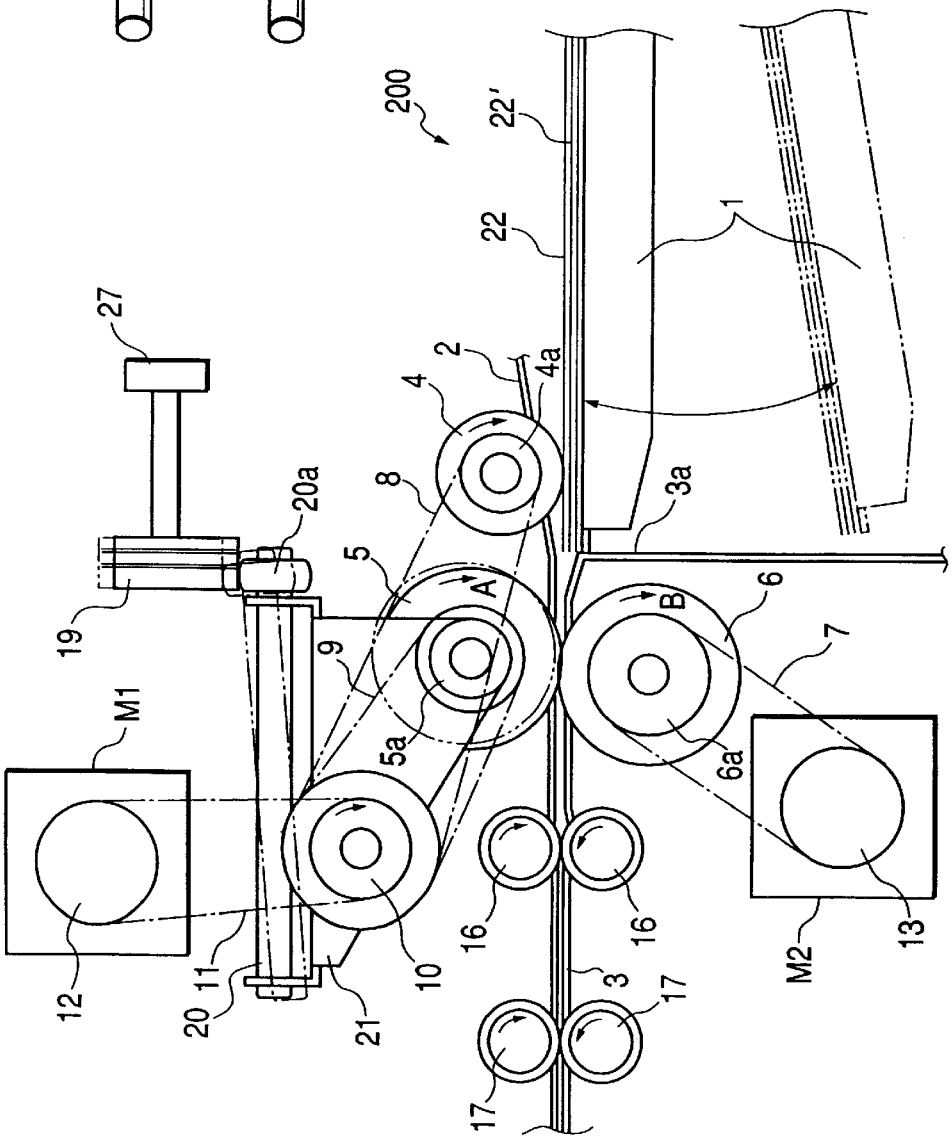
FIG. 13A PRIOR ART

FIG. 1 schematically shows the construction of a sheet feeding apparatus according to a first embodiment of the present invention. Constituent members and portions common to those of the aforedescribed sheet feeding apparatus of FIGS. 13A and 13B are given common reference characters and need not be described again.

In the sheet feeding apparatus according to the present embodiment, first and second sheet sensors 14 and 15 as sheet detecting means are disposed at the sheet entrance side and the sheet exit side, respectively, of the nip portion between a pair of feeding roller and separating roller 5 and 6.

The first sheet sensor 14 serves to detect a sheet fed to the nip portion between the pair of feeding roller and separating roller 5 and 6 by a sheet feeding roller 4, and this sensor will hereinafter be referred to as the pre-sheet feeding sensor.

The second sheet sensor 15 serves to detect a sheet which has passed through the nip portion between the pair of feeding roller and separating roller 5 and 6, and this sensor will hereinafter be referred to as the post-sheet feeding sensor.

Also, in the sheet feeding apparatus according to the present embodiment, the rotation of the eccentric cam 19 of the inter-shaft distance changing mechanism 19, 20*a*, 20, 21 of the pair of feeding roller and separating roller 5 and 6 may be automatically effected by a stepping motor M3 instead of a manually operated adjusting knob 27.

That is, the sheet detection signals of the pre-sheet feeding sensor 14 and the post-sheet feeding sensor are inputted to a control portion (hereinafter referred to as the CPU) 26. The CPU 26 controls the driving of the stepping motor M3 in conformity with the thickness of a fed sheet on the basis of the detection signal of one of the pre-sheet feeding sensor 14 and the post-sheet feeding sensor 15 and rotates the eccentric cam 19 of the inter-shaft distance changing mechanism of the pair of feeding roller and separating roller 5 and 6 to thereby change the inter-shaft distance between the feeding roller 5 and the separating roller 6 and appropriately automatically adjust the amount of entry or the amount of gap of the feeding roller 5 with respect to the separating roller 6 in accordance with the thickness of the sheet.

Figure 2:
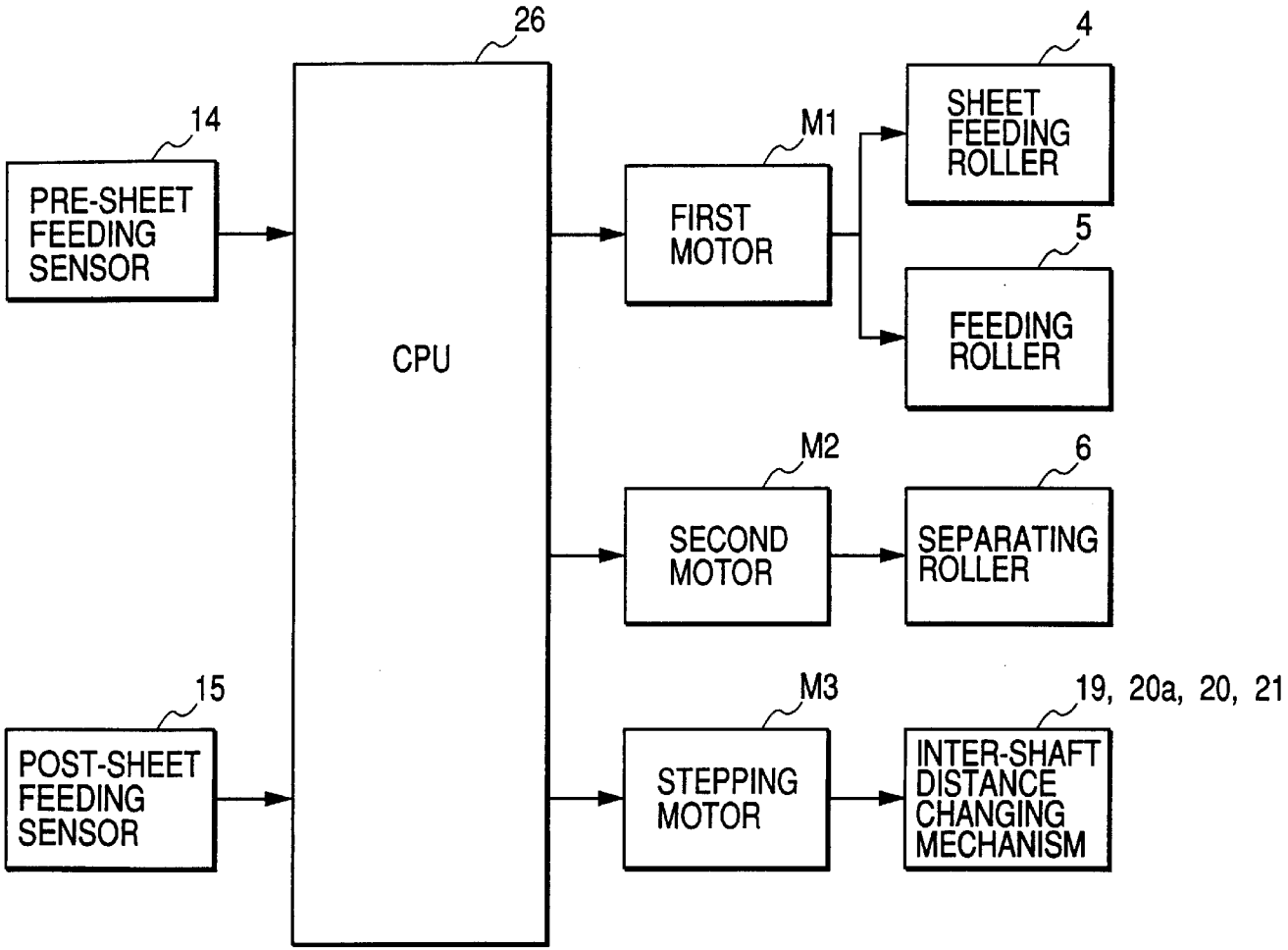
FIG. 2 is a block diagram of a control system.
Figure 3:
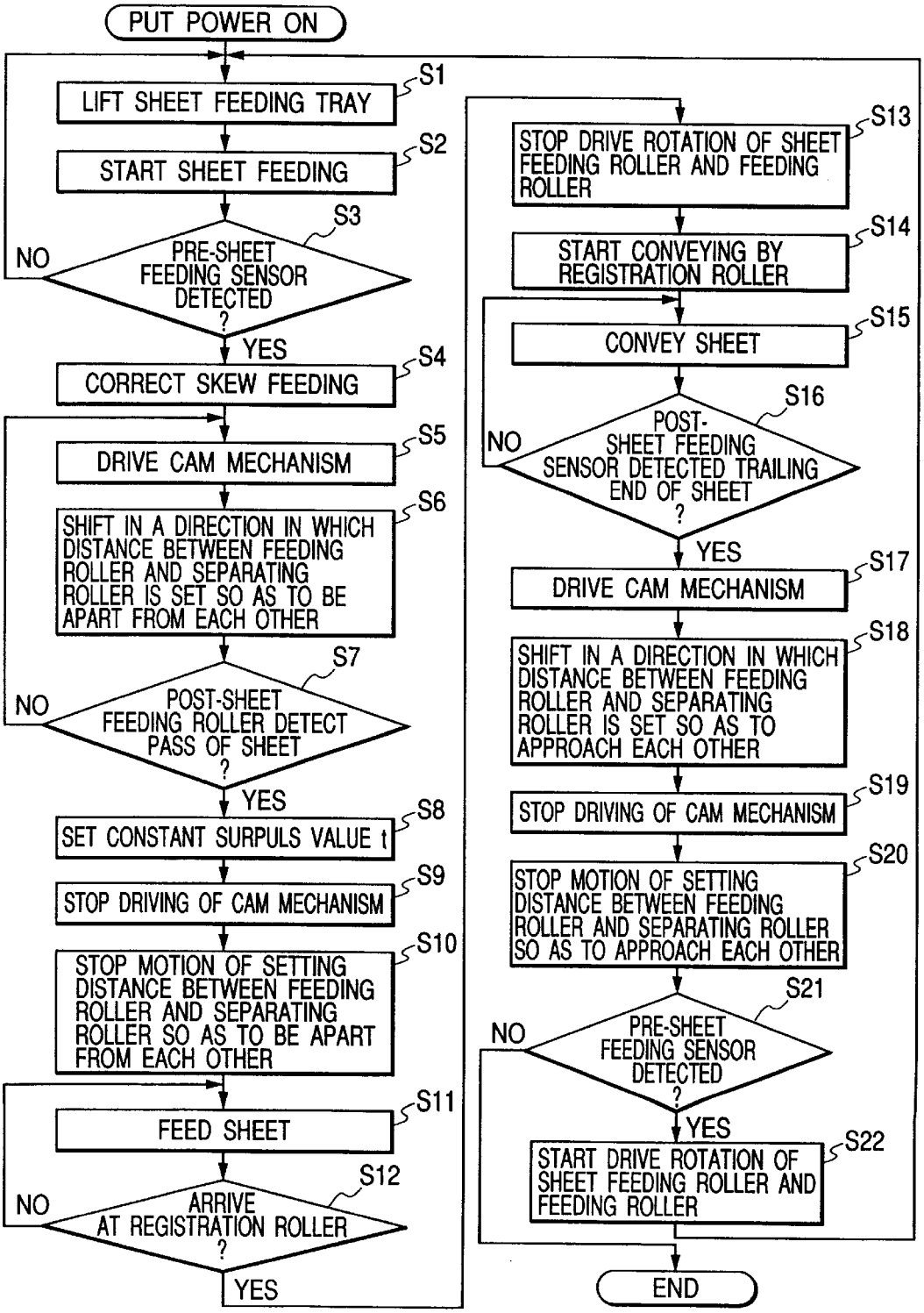
FIG. 3 is a flow chart of operation.

FIG. 2 is a block diagram of the control system of the apparatus, and FIG. 3 is a flow chart of the operation of the apparatus. The signals from the pre-sheet feeding sensor 14 and the post-sheet feeding sensor 15 are controlled and calculated by the CPU 26, and an operating signal is sent to the first motor M1, the second motor M2 and the stepping motor M3, thereby giving driving to the mechanism allotted to each of them.

In the operation flow of FIG. 3, the manner of piling and setting sheets 200 on the sheet supply tray 1, the upward movement of the sheet supply tray 1 and the start of the sheet feeding (pick-up) by the rotation of the sheet feeding roller 4 are the same as those in the aforedescribed sheet feeding apparatus of FIGS. 13A and 13B (steps S1 and S2).

A sheet 22 which has arrived at the nip portion between the feeding roller 5 and the separating roller 6 is detected by the pre-sheet feeding sensor 14 (step S3), and strikes against the nip portion between the feeding roller 5 and the separating roller 6 which are in a state in which they are in non-contact with each other and overlap each other axially thereof to thereby hamper the feeding of the sheet (set position) (step S4).

Here, for example, when the sheet 22 is not aligned and is fed with the end surface of the piled sheets 200 being not uniformized, or when the sheet 22 is skew-fed or conveyed by the sheet feeding roller 4, the leading end portion of the fed sheet 22 strikes against the surface of nip between the feeding roller 5 and the separating roller 6, and this sheet 22 is pushed in feeding by the sheet feeding roller 4, whereby the end surface of the skew-fed sheet 22 is aligned on the surface of nip between the feeding roller 5 and the separating roller 6 and the posture thereof is corrected.

Figure 4:
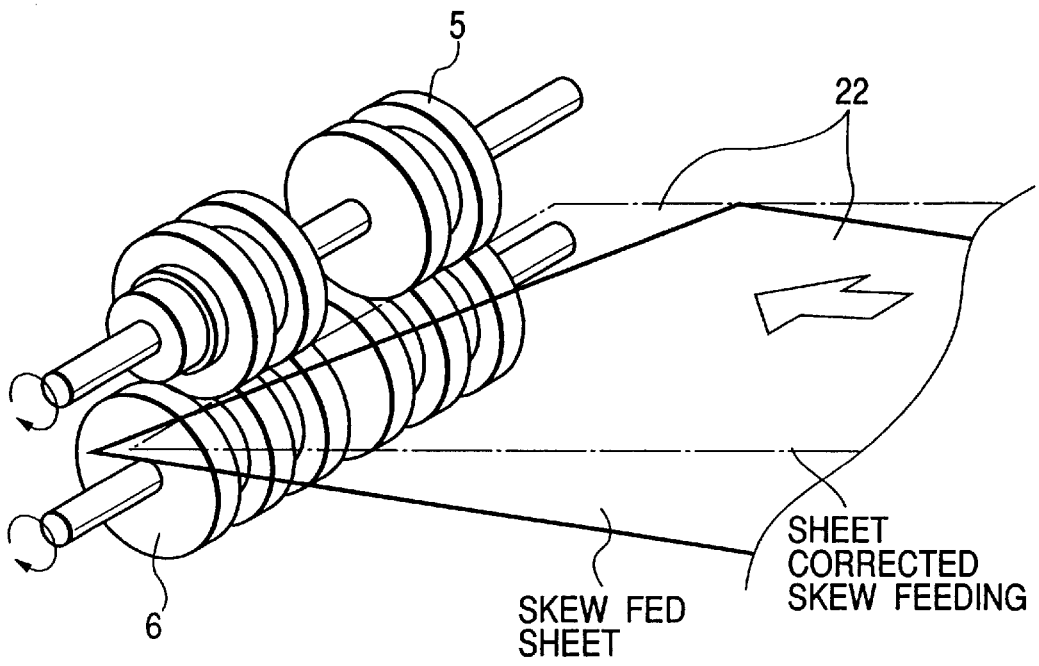
FIG. 4 is a perspective view showing the manner in which a skew-fed sheet is rammed against a feeding roller and a separating roller to thereby correct the skew feeding.

FIG. 4 shows a state in which the end surface of this sheet 22 is aligned and the posture thereof is corrected. Thereafter, the sheet 22 corrected in skew feeding is conveyed as follows.

Figure 5:
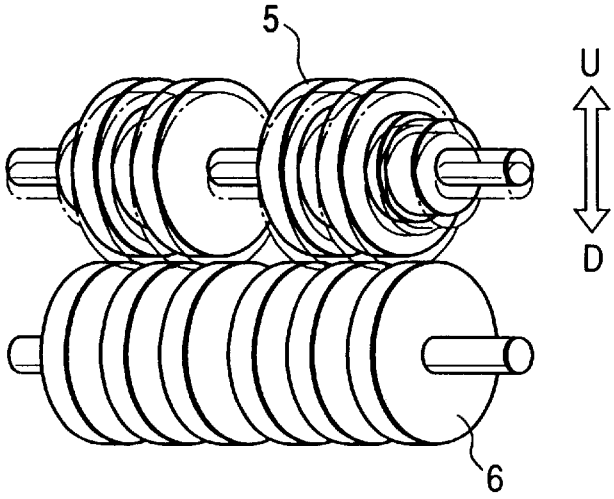
FIG. 5 is a perspective view showing the vertical movement of the feeding roller.

When the sheet 22 fed to the nip portion between the pair of feeding roller and separating roller 5 and 6 by the sheet feeding roller 4 is detected by the pre-sheet feeding sensor, the CPU 26 drives the stepping motor M3 of the inter-shaft distance changing mechanism M3, 19, 20*a*, 20, 21 and controls the movement of the feeding roller 5 in a direction away from the separating roller 6, i.e., an upward direction U as indicated in FIG. 5 (step S6).

From the set position of a state in which the feeding roller 5 and the separating roller 6 formed with comb-tooth like grooves on the outer peripheral portions thereof are opposed to each other and the concave surfaces and convex surface of the grooves overlap each other axially thereof in non-contact with each other to thereby hamper sheet feeding, the feeding roller 5 is moved upwardly to widen the spacing thereof with respect to the separating roller 6 in the inter-shaft direction thereof, and by the driving rotation of the sheet feeding roller 4 and the driving rotation of the feeding roller 5, there is provided a spacing enough to be capable of feeding a sheet 22 striking against the nip portion between the feeding roller 5 and the separating roller 6.

Here, when sheets 22, 22', . . . are double-fed, the uppermost sheet 22 directly contacting with the feeding roller 5 is fed by the feeding roller 5 being rotated in the forward feeding direction, and the other double-fed sheets 22', . . . are reversely conveyed by the separating roller 6 being rotated in the reverse feeding direction and are prevented from entering or passing through the nip portion, whereby double feeding is prevented. Thereby, only the sheet 22 which is in contact with the feeding roller 5 is separated and conveyed.

When the uppermost sheet 22 has passed through the spacing between the feeding roller 5 and the separating roller 6, the post-sheet feeding sensor 15 detects the passage of the sheet 22 (step S7), and transmits a detection signal to the CPU 26.

In response to the detection signal, the CPU 26 feeds back the signal to the stepping motor M3 to thereby stop the driving of the stepping motor M3. At this time, the feeding roller 5 provides a spacing corresponding to the thickness of the sheet 22 with respect to the separating roller 6, and in addition, such a constant surplus value that in sheet feeding, no load is applied to the sheet 22 and the sheet can smoothly pass between the feeding roller 5 and the separating roller 6 (step S8). That is, the stepping motor M3 is stopped when a predetermined inter-shaft distance suited for the thickness of the sheet is provided, and the feeding roller 5 and the separating roller 6 are stopped in a predetermined position wherein only one sheet is appropriately separated and fed. That is, the eccentric cam 19 connected to the stepping motor M3, which is now stopped, stops its driving rotation (step S9), whereby the operation of the inter-shaft distance changing mechanism of the feeding roller 5 and the separating roller 6 is stopped (step S10).

When the sheet 22 detected by the post-sheet feeding sensor 15 has its arrival at and conveyance by the registration rollers 16 detected by the CPU 26 provided with calculating means for detecting the timing at which the sheet 22 is fed to the registration rollers 16, from the conveyance speed of the sheet 22 and the distance between the post-sheet feeding sensor 15 and the registration rollers 16 on the basis of the time until the sheet 22 arrives at the registration rollers 16 or the preset pulse number of the motor, the driving rotation of the sheet feeding roller 4 and the feeding roller 5 is stopped to avoid the succeeding feeding of the next sheets 22', . . . (step S13).

Thereafter, the fed sheet 22 has its conveyance timing determined by the registration rollers 16, and is conveyed to the conveying rollers 17.

Since the sheet 22 is now conveyed by the registration rollers 16, the sheet feeding roller 4 and the feeding roller 5 have their driving released and become idly rotated (step S14).

Thereafter, when the post-sheet feeding sensor 15 detects that the fed sheet 22 has passed between the feeding roller 5 and the separating roller 6 (step S16), the driving of the stepping motor M3 of the inter-shaft distance changing mechanism is resumed. The driving of the stepping motor M3 at this time is in a direction to move the feeding roller 5 downwardly as shown in FIG. 5 (step S17).

Thereby, the feeding roller 5 and the separating roller 6 approach each other axially thereof in non-contact with each other, and return to the state before feeding in which they overlap each other and hamper sheet feeding, i.e., the set position (step S18).

Then, on the basis of the driving of the stepping motor M3 being stepped and the operation of the inter-shaft distance changing mechanism being stepped, the operation of the feeding roller 5 and the separating roller 6 approaching each other axially thereof in non-contact with each other is also stopped, and the state before sheet feeding is brought about (step S20).

Even if at this time, sheets of different thicknesses are mixed and fed, the feeding roller 5 and the separating roller 6 are moved as described above and the passage of each sheet 22 is detected by the sheet detecting sensor and therefore, the sheet can be automatically separated and fed independently of the thickness thereof.

Next, when it is detected by the pre-sheet feeding sensor 14 that the second sheet 22' has been fed (step S21), the sheet feeding roller 4 and the feeding roller 5 start their driving rotation (step S22), and start the feeding of the second sheet 22' (steps S1 and S3).

The above-described series of operations are performed for each sheet 22.

<Second Embodiment>

Figure 6:
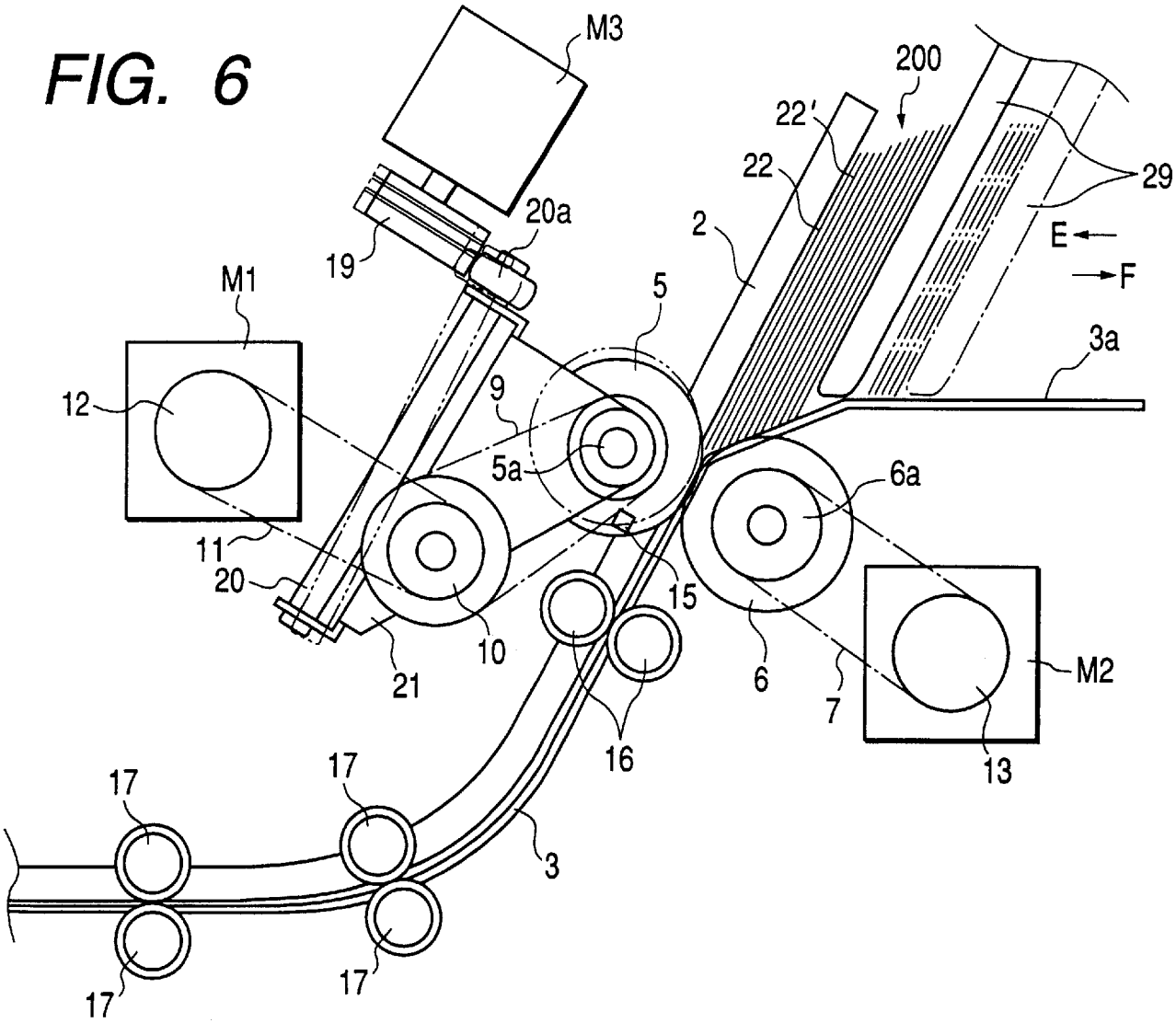
FIG. 6 schematically shows the construction of a sheet feeding apparatus according to a second embodiment of the present invention.
Figure 7:
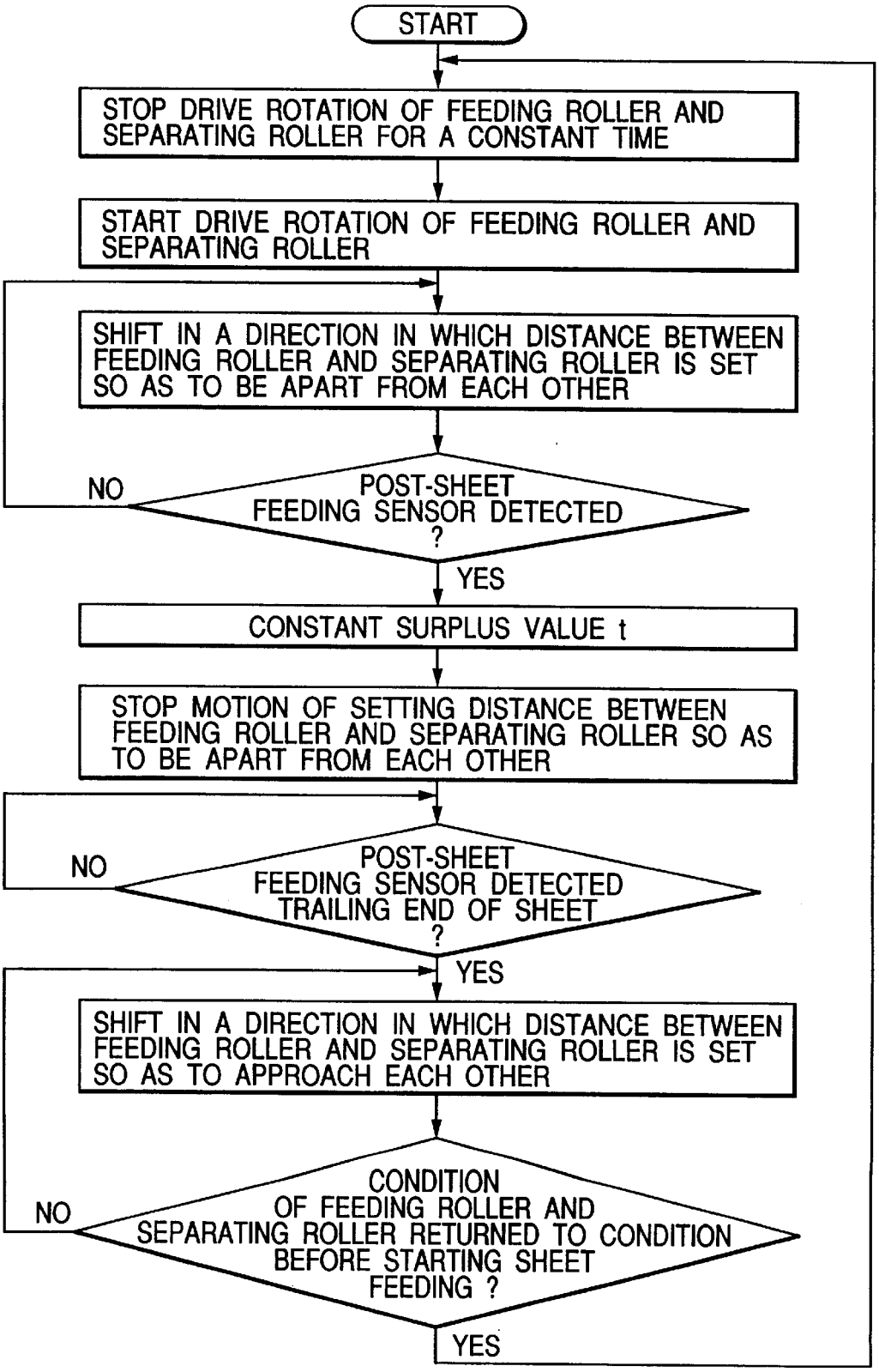
FIG. 7 is a flow chart of operation.

(FIGS. 6 and 7)

FIG. 6 schematically shows the construction of a sheet feeding apparatus according to a second embodiment of the present invention.

The difference of the second embodiment from the first embodiment is that in the first embodiment, sheet feeding is effected by the sheet feeding roller 4, whereas in the present embodiment, the surface direction of the sheets 200 is supported by a sliding type sheet guide 29 slidable in the directions of arrows E and F and the upper guide plate 2, and the fed side end surface of the sheet is supported by a sheet leading end ramming plate portion 3*a* which is the extension of the lower guide plate 3, and sheet feeding is effected by the aforementioned sliding type sheet guide 29.

Also, the sheets 200 ram against the feeding roller 5 and the separating roller 6 from first and therefore, the pre-sheet feeding sensor 14 becomes unnecessary, and an operation similar to that of the first embodiment becomes possible by only the post-sheet feeding sensor 15.

Describing the operation of the present embodiment, the sheets 200 set at a predetermined position during sheet feeding are fed in the direction of arrow E to the sheet feeding portion (nip portion) in which the feeding roller 5 and the separating roller 6 overlap each other by the sliding type sheet guide 29 while ramming their end surface against the sheet leading end ramming plate portion 3*a*.

Near the sheet feeding portion, the sheets 200 slide to the sheet feeding portion along the sheet leading end ramming plate portion 3*a* of a tapered shape from gravity, and strike against the overlapping portion of the feeding roller 5 and the separating roller 6 and are corrected in skew-feeding. At this time, the sliding type sheet guide 29 holds the posture of the sheets 200 by the upper guide plate 2, and the feeding roller 5 and the separating roller 6 against which the sheets 200 strike are in a state in which their driving rotation has been stopped.

Next, the feeding roller 5 and the separating roller 6 start their driving rotation after a sufficient time has passed from after the sheets 200 have been set at a predetermined position and the sliding type sheet guide 29 has been moved.

Thereafter, the feeding roller 5 is moved in a direction to space its inter-shaft distance from the separating roller 6.

By the above-described operation, an operation similar to that of the first embodiment is performed after the feeding of the sheets 200 has been started.

The flow chart of the above-described operation is shown in FIG. 7.

<Third Embodiment>

(FIG. 8)

Figure 8:
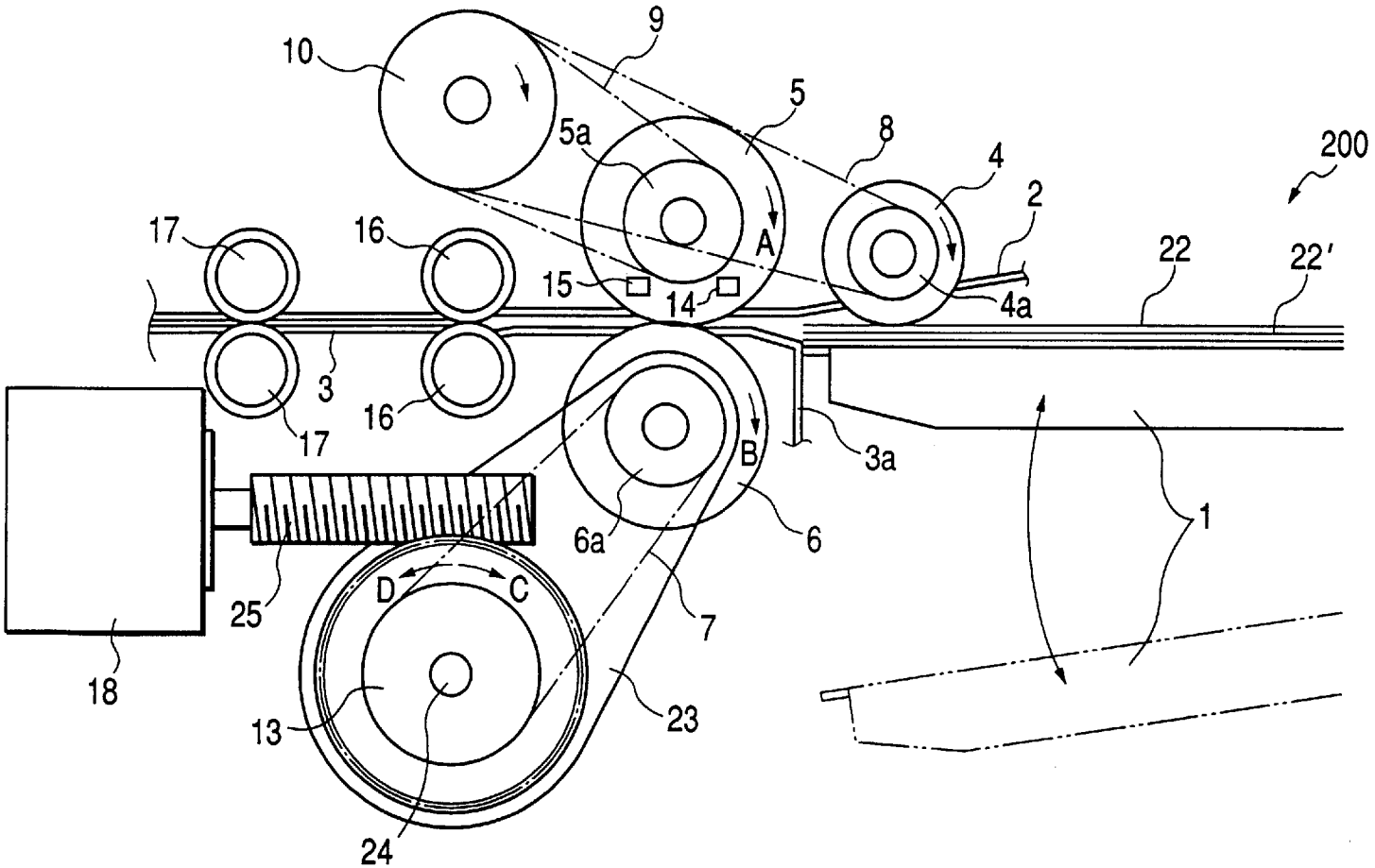
FIG. 8 schematically shows the construction of a sheet feeding apparatus according to a third embodiment of the present invention.

FIG. 8 schematically shows the construction of a sheet feeding apparatus according to a third embodiment of the present invention.

The difference of the present embodiment from the first embodiment is that in the first embodiment, the feeding roller 5 is vertically movable, whereas in the present embodiment, the separating roller 6 is vertically movable and the feeding roller 5 is in a fixed position.

The separating roller 6 is held on a movable chassis 23 coaxial with the support shaft 24 of the pulley 13 rotatively driven by the second motor M2 (not shown) and pivotally movable. The separating roller 6 receives a driving force through the pulley 13, the belt 7 and the pulley 6*a* and is rotated thereby.

The reference numeral 25 designates a gear coaxial with the shaft 24 and provided integrally with the movable chassis 23. The reference numeral 26 denotes a worm gear meshing with this gear 25. This worm gear 26 is rotation-controlled by the stepping motor M3.

By the stepping motor M3 being rotated forwardly and reversely, the gear 25, i.e., the movable chassis 23, is pivotally moved in a clockwise direction C or a counter-clockwise direction D about the shaft 24 by the worm gear 26.

By the movable chassis 23 being pivotally moved in the clockwise direction C, the separating roller 6 is moved in a direction to space the distance from the feeding roller 5, i.e., downwardly.

When the post-sheet feeding sensor 15 detects that a sheet 22 has passed between the feeding roller 5 and the separating roller 6 spaced apart from each other, the movable chassis 23 is pivotally moved in the counter-clockwise direction D. Thereby, the separating roller 6 is moved in an upward direction which is a direction in which it overlaps the feeding roller 5 axially thereof in non-contact with the latter, and stops its upward movement at a position before sheet feeding. In the meantime, the separating roller 6 receives a driving force through the pulley 13, the belt 7 and the pulley 6*a* and is rotated thereby.

These operations, as in the first embodiment, are performed for each sheet being fed.

1) The feeding roller and the separating roller need not be comb-toothed rollers. Also, one or both of them may be a rotatable belt.

2) The inter-shaft distance changing mechanism of the feeding roller and the separating roller can be made into a construction in which both of the feeding roller and the separating roller are moved in a direction to widen the inter-shaft distance and a direction to narrow the inter-shaft distance.

3) The present invention is not restricted to an apparatus of the upper side separating and feeding type in which feeding is effected in succession from the upper one of the piled sheets, but can also be applied to an apparatus of the lower side separating and feeding type in which feeding is effected in succession from the lower one of the piled sheets.

4) The sheet feeding apparatus of the present invention can be widely used as an apparatus for conveying sheets such as cards and thin paper leaves piled in an image forming apparatus such as a rotary type camera, a facsimile apparatus, a printing machine, a copying machine, a printer or a word processor, or other various sheet-using apparatuses such as an automatic original feeding apparatus, a punching machine and a paper binding machine one by one to a sheet processing portion such as an image forming portion, an exposure portion or a processing portion.

As described above, according to the present invention, there can be provided a sheet feeding apparatus which can automatically separate and convey sheets of different thicknesses by a simple construction and can also automatically correct the skew feeding of the sheets.

That is, the sheet feeding apparatus according to the present invention can feed sheets independently of the thicknesses of the sheets and yet can avoid double feeding and can accurately feed the sheets one by one even if sheets of different thicknesses are mixed.

Also, the end surface of a skew-fed sheet can be rammed against the sheet feeding rotatable member and the sheet separating rotatable member which overlap each other axially thereof in non-contact with each other to thereby effect the correction of skew feeding.

Thus, it becomes unnecessary to manually adjust the sheets for each thickness thereof, and it also becomes unnecessary to detect the posture of the sheet being conveyed and correct the skew feeding thereof in the conveyance path.

The automatic separation of sheets and the correction of skew feeding can be accomplished by only the sheet feeding rotatable member and the sheet separating rotatable member and therefore, the apparatus itself becomes very compact and simple.

<Fourth Embodiment>

Figure 9:
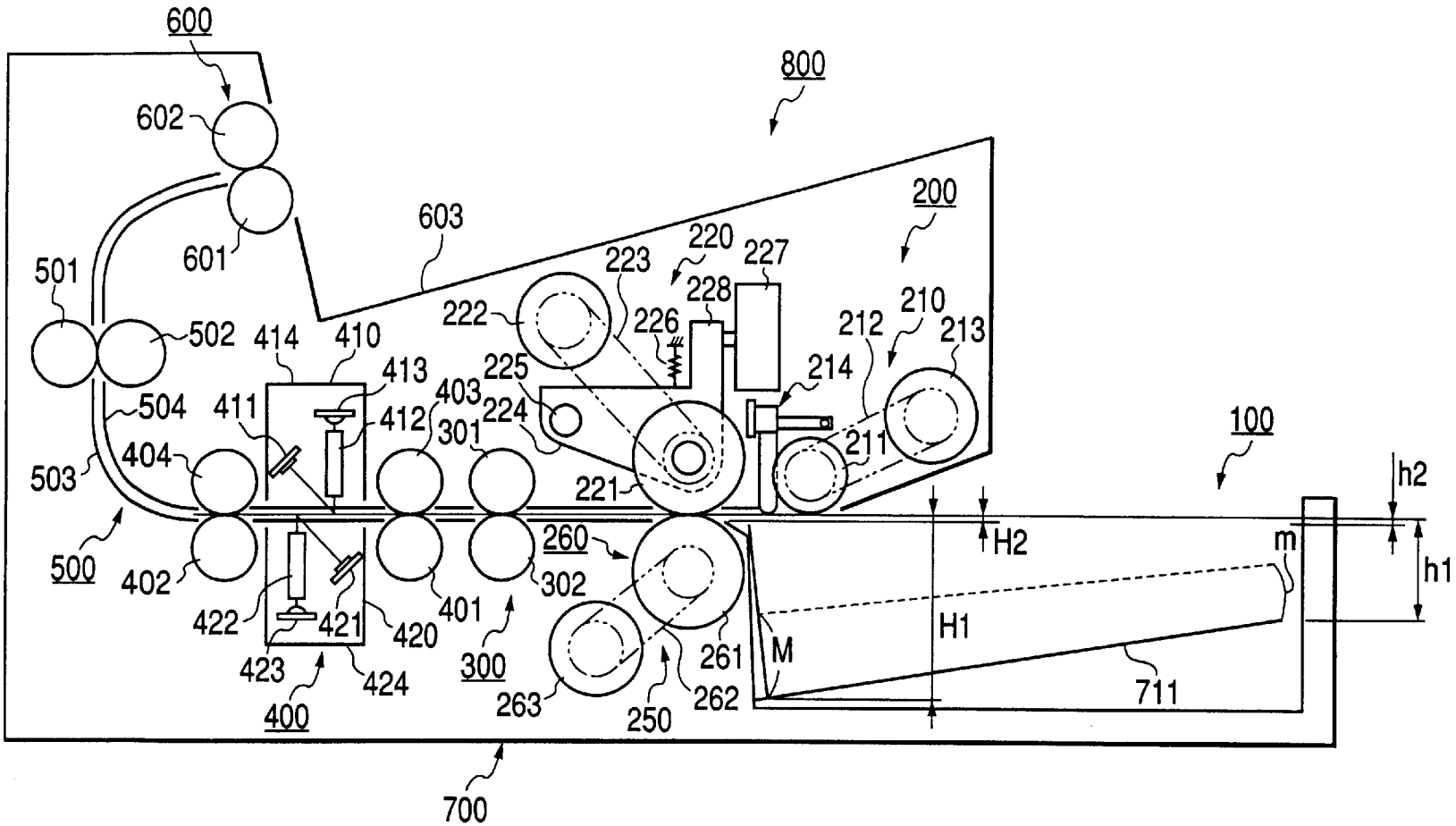
FIG. 9 is an illustration of the cross-sectional construction of a fourth embodiment of an image reading apparatus to which the present invention is applied.

FIG. 9 is an illustration of the cross-sectional construction of an image reading apparatus as a sheet material processing apparatus to which the present invention is applied. The reference numeral 100 designates an original supporting portion for supporting originals as sheet materials thereon, and the operation thereof is designed to satisfy the following relations:

$$H1 > h1,$$

$$H2 \geqq h2,$$

$$M \geqq m,$$

$$h1 \neq h2,$$

where H1 and h1 are the distances (distances in the direction of height) of the entrance side end portion and the opposite side end portion, respectively, of the conveyance path of the original supporting portion when the original supporting portion 100 capable of supporting a plurality of originals thereon is in its lowermost position, from the horizontal extension of the original entrance height (sheet feeding position), H2 and h2 are the distances thereof when the original supporting portion 100 is in its uppermost position, and M and m are the amounts of movement thereof from the start of the operation thereof.

Figure 10:
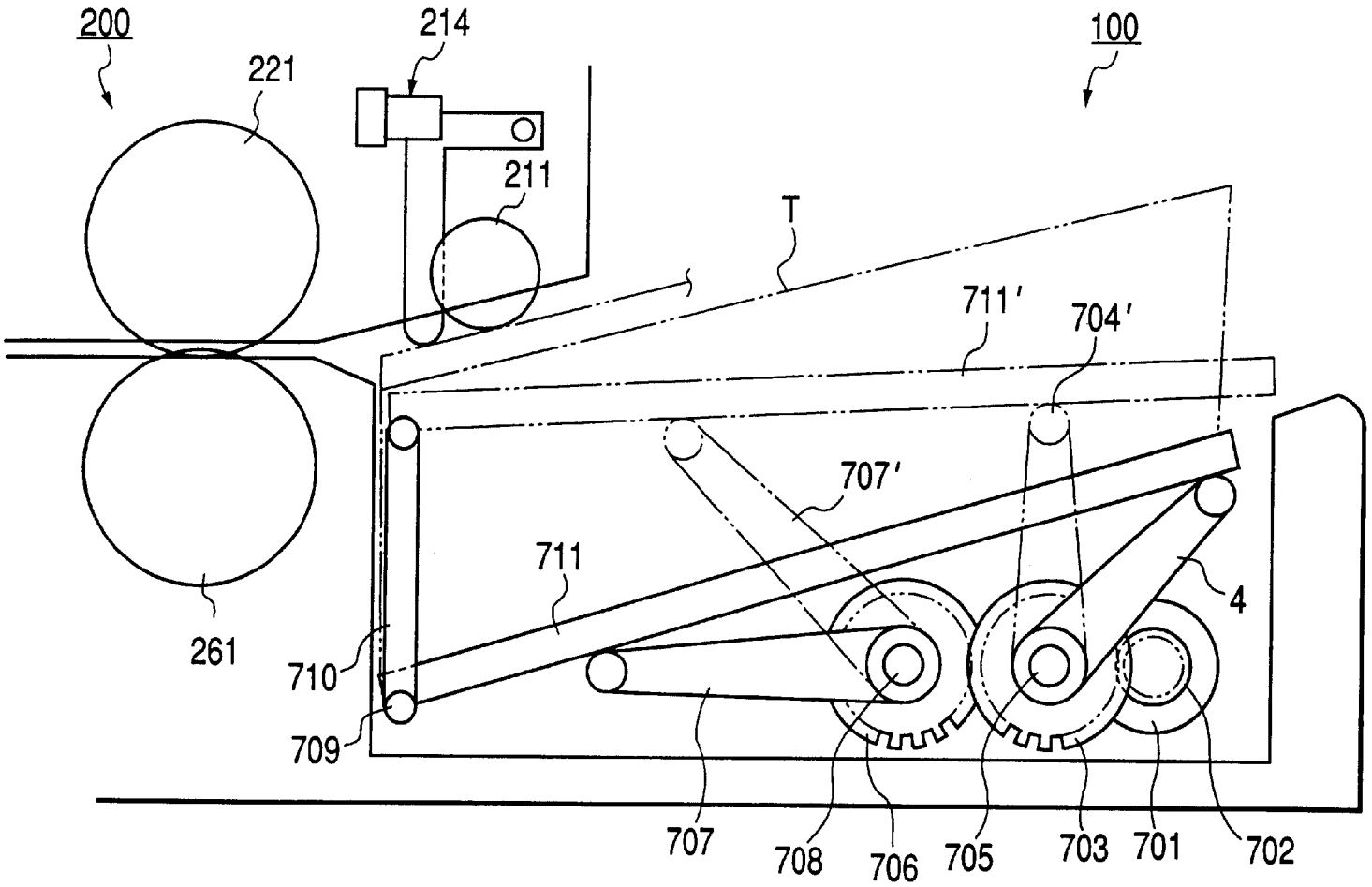
FIG. 10 is an illustration of the cross-sectional construction of an original supporting portion in the fourth embodiment of the present invention.

The detailed construction of the original supporting portion 100 is shown in FIG. 10, and will be described later.

In FIG. 9, a sheet feeding portion 200 is comprised of a separating and conveying portion 250 comprising a pickup portion 210, a feed roller unit 220 and a separating unit 260 constituting feeding means.

In the pickup portion 210, the reference numeral 211 designates a pickup roller for feeding an original from an original introducing port to a separating portion, and the driving force from a motor 213 is transmitted thereto by a belt 212.

Detecting means 214 comprising a lever and a sensor for detecting the height of the originals contacts with the uppermost one of the originals supported on the original supporting table. The operation of the original supporting table 11 is controlled so as to make the position of the uppermost original constant.

The separating and conveying portion 250 is designed to separate and convey only the uppermost one of a plurality of originals fed in by the pickup roller 211, by the feed roller unit 220 and the separating unit 260.

The feed roller unit 220 is provided with a feed roller 221 rotatable in the direction of conveyance, a motor 222 for driving it, and a belt 223 connecting these together.

A frame 224 holds the feed roller 221 for pivotal movement about a shaft 225. The feed roller 221 is upwardly biased by a spring 226 and also is pivotally moved about the shaft 225 by a cam 228 integral with a motor 227.

The cam 228 is designed to be capable of adjusting the inter-shaft distance between the feed roller 221 and a separating roller 261 by the thickness of an original to be conveyed.

Also, the separating roller 261 of the separating unit 260 (separating portion) is connected to a motor 263 by a belt 262 and is rotated in a direction opposite to the direction of rotation of the feed roller, thereby stopping the entry of the other originals of those fed originals than the uppermost original into the separating portion and subsequent portions.

A registering portion 300 has an upper registration roller 301 and a lower registration roller 302, which are connected together by a gear, not shown. Also, this pair of registration rollers 301 and 302 have their connection and non-connection controlled for the driving from a main motor by a clutch, not shown, and control the conveyance of an original conveyed from the separating portion to an image reading portion.

The reference numeral 400 denotes an image reading portion, and in the interior of an upper reading unit 410, an LED array 411 which is an illuminating light source an imaging lens array 412, and an image reading close contact sensor 413 are contained in a casing 414.

In the interior of a lower reading unit 420, an LED array 421 which is an illuminating light source, an imaging lens array 422 and an image reading close contact sensor 423 are contained in a casing 424.

Reading guide rollers 401 and 402 receives the driving force from the main motor transmitted by driving transmitting means such as a belt, not shown. The reference numerals 403 and 404 designate driven rollers forming pairs with the above-mentioned reading guide rollers.

The reference numeral 500 denotes a conveying portion, and the reference numeral 501 designates a conveying roller to which the driving from the main motor is connected. The reference numeral 502 denotes a driven roller opposed to the conveying roller 501. The reference numerals 503 and 504 designate conveyance guides for guiding the original which has passed the reading portion.

The reference numeral 600 denotes a sheet discharging portion for discharging the original which has passed the conveying portion therefrom onto a sheet discharge tray 603 by a sheet discharging roller 601 and a driven roller 602. Also, in the sheet discharging portion 600, there are provided a plurality of resilient members, not shown, for waving the original in a direction orthogonal to the direction of conveyance of the original during the passage of the original to thereby prevent the rounding of the direction of conveyance and secure the alignment of discharged sheets.

The reference numeral 700 designates a lower unit in which there are disposed the original supporting portion 100, the separating unit 260, the registering portion 300, the reading guide rollers 401, 402, the lower reading unit 420, the conveying roller 501 the conveyance guide 503 and the sheet discharging portion 600.

The reference numeral 800 denotes an upper unit disposed above the lower unit 700 and openable and closable coaxially with the sheet discharging roller 601 relative to the lower unit 700.

In this upper unit 800, there are contained the pickup portion 210, the feed roller unit 220, the reading driven rollers 403, 404, the upper reading unit 410, the driven roller 502, the conveyance guide 504, etc.

The details of the original supporting portion 100 will now be described with reference to FIG. 10.

In the embodiments of the present invention, the original supporting portion 100 can operate so as to satisfy the following relations:

$$H1 > h1,$$

$$H2 \geqq h2,$$

$$M \geqq m,$$

$$h1 \neq h2,$$

where H1 and h1 are the distances of the entrance side end portion and the opposite side end portion, respectively, of the conveyance path of the original supporting portion when the original supporting portion supporting a plurality of originals thereon is in its lowermost position, from the horizontal extension of the original entrance height, H2 and h2 are the distances thereof when the original supporting portion is in its uppermost position, and M and m are the amounts of movement thereof from the start of the operation thereof, and therefore an example of a construction which satisfies then is shown in FIG. 10.

In FIG. 10, the reference numeral 701 designates a motor as an operation actuator which is an element of sheet material supporting portion driving means for moving up and down the original supporting table 711 of the original supporting portion 100, the reference numeral 702 denotes a gear mounted on a motor shaft, and the reference numeral 703 designates a gear rotatably mounted on a shaft 705 and meshing with the motor gear 702.

The reference numeral 704 denotes a rear end push-up arm mounted on the gear 703 for pushing up the rear end of the original supporting table 711, the reference numeral 706 designates a gear rotatably mounted on a shaft 708, the reference numeral 707 denotes a fore end push-up arm mounted on the gear 706 for pushing up the fore end of the original supporting table 711, and the reference numeral 709 designates a boss mounted on the fore end of the original supporting table 711 and meshing with a guide groove 710 to thereby vertically guide the fore end of the original supporting table 711.

The original supporting table 711 indicated by solid line in FIG. 10 shows its lowermost position and at this time, the rear end push-up arm 704 and the fore end push-up arm 707 are in contact with the underside of the original supporting table 711.

When the original supporting table 711 is in this state, a bundle of originals T are piled on the original supporting table 711, whereafter the start of original reading is instructed.

The motor 701 is driven to move up the original supporting table 711 until the surface of the originals reaches a prescribed position by the detecting means 214, and in accordance therewith, the gears 702, 703, 706 and the fore end/rear end push-up arms 707, 704 connected to the motor 701 operate so as to push up the original supporting table 711. The fore end of the original supporting table 711 is moved up along the guide groove 710.

In the present embodiment, the rear end push-up arm 704 and the fore end push-up arm 707 have their angles of rotation set equally, and depending on the lengths of the arms and the angles thereof relative to the original supporting table 711, the amounts of operation of the fore end side and rear end side of the original supporting table 711 are set. These amounts of operation are maintained in the relation that $M \geqq m$.

The original supporting table 711 is controlled so that the level of the uppermost one of the bundle of originals T piled thereon may be constant and therefore, with a decrease in the originals, the original supporting table 711 is moved up and finally, it reaches the uppermost position indicated by dots-and-dash lines 704', 707' and 711', and it is detected by detecting means, not shown, that it has reached the uppermost position.

If at this time, the detecting means 213 detects no original, it is judged that the originals on the original supporting table 711 have become exhausted, and the original supporting table 711 is returned to its lowermost position, thus completing the operation.

By the original supporting portion 100 having such a construction and operation, it has become possible to provide an image reading apparatus which suppresses the variation in the angle of inclination of the originals on the original supporting table 711 and which has both of the operability when an original supporting table of the fixed pivot type is used and a practically sufficient sheet feeding capacity, with a compact apparatus size.

While in the fourth embodiment, the image reading apparatus has been described as a sheet material processing apparatus, an apparatus provided with image forming means for forming an image on a recording material as a fed sheet material, instead of the reading portion 400 for reading the image information of the original, can also obtain a similar effect.

<Fifth Embodiment>

Figure 11:
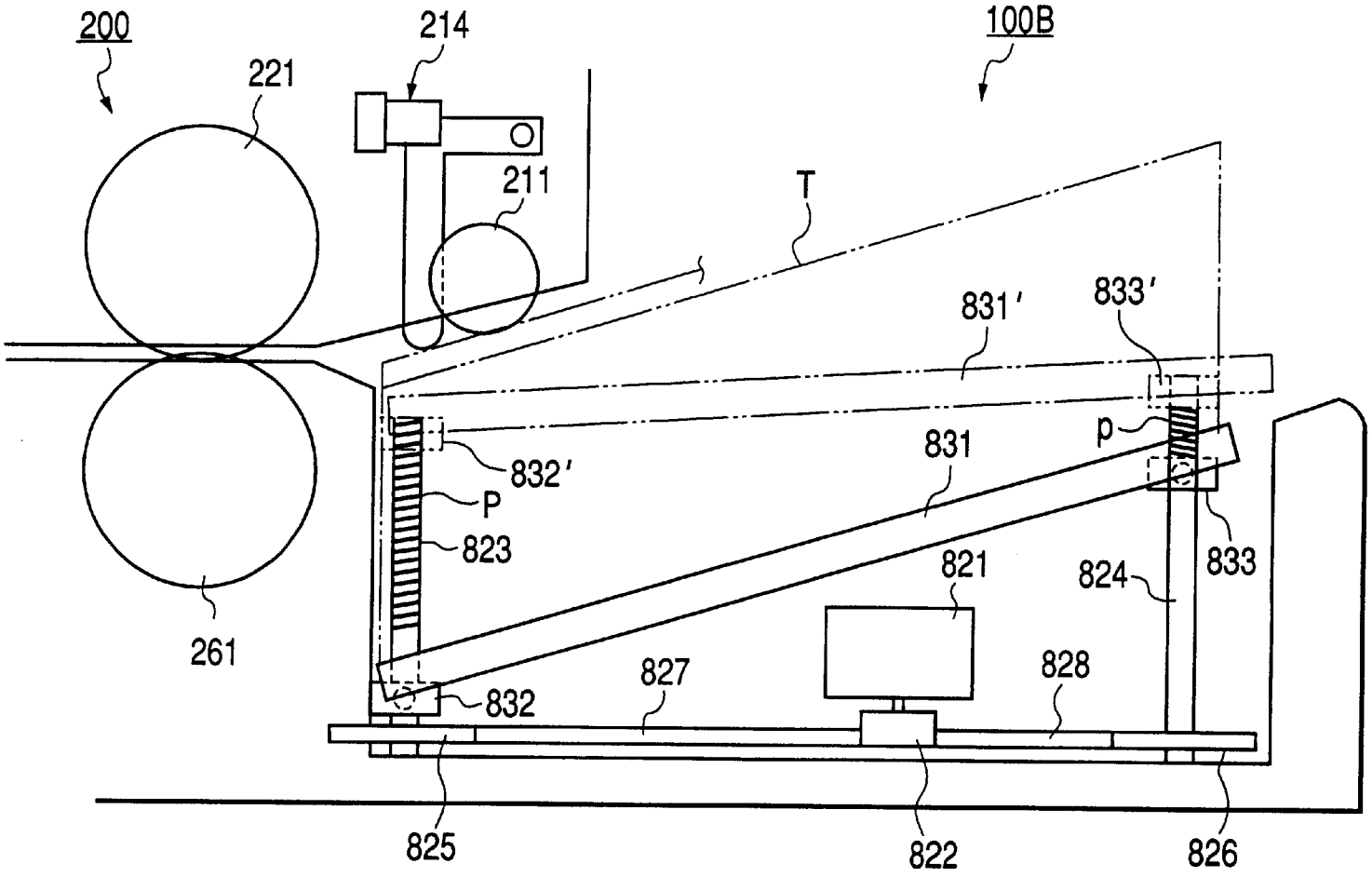
FIG. 11 is an illustration of the cross-sectional construction of an original supporting portion in a fifth embodiment of the present invention.

FIG. 11 is an illustration of the cross-sectional construction of a fifth embodiment of the original supporting portion 100B of an image reading apparatus to which the present invention is applied. The construction of the sheet feeding portion 200 and subsequent portions in this embodiment is similar to that in the fourth embodiment and therefore need not be described. Also, the operating conditions of the original supporting table 831 of the sheet feeding portion 200 is similar to those in the fourth embodiment.

In FIG. 11, the reference numeral 821 designates a motor as an operation actuator for the original supporting portion, the reference numeral 822 denotes a gear mounted on a motor shaft, the reference numeral 823 designates a shaft formed with a feed screw at a pitch P, and the reference numeral 824 denotes a shaft formed with a feed screw at a pitch p, and the pitches are in the relation that $P>p$.

The reference numerals 825 and 826 designate gears mounted on the shafts 823 and 824, respectively, and the reference numerals 827 and 828 denote idler gears for transmitting the driving of the motor gear 822 to the gears 825 and 826, respectively.

The reference numeral 831 designates an original supporting table having on the fore end side a fore end frame 832 meshing with the feed screw formed on the shaft 823 and vertically movable by the rotation of the feed screw and pivotally held, and having on the rear end side a rear end frame 833 meshing with the feed screw formed on the shaft 824 and vertically movable by the rotation of the feed screw and movably and pivotally held along the original supporting table.

The original supporting table 831 indicated by solid line shows its lowermost position, and in this state, a bundle of originals T are piled thereon. The uppermost position of the original supporting table 831 is shown as the original supporting table 831' by dots-and-dash line.

The feed pitches P and p of the feed screws are set so that the original supporting table can be moved in the relation that $M \geqq m$ between the original supporting table 831 in its lowermost position and the original supporting table 831' in its uppermost position.

When the conveyance of the originals is instructed, the motor 821 is rotated to thereby rotate the shafts 823 and 824 through the idler gears 827, 828 and the gears 825, 826, and the original supporting table 831 is pushed up by the feed screws.

When it is detected by the detecting means 214 that the uppermost one of the piled bundle of originals T has reached a prescribed level, the motor 821 is stopped and the originals are conveyed one by one as in the fourth embodiment.

The original supporting table 831 is controlled so that the level of the uppermost one of the piled originals may be constant and therefore, with an increase in the originals, the original supporting table 831 is moved up and finally, it reaches the uppermost position indicated by dots-and-dash lines 831', 832' and 833', and it is detected by detecting means, not shown, that it has reached the uppermost position.

If at this time, the detecting means 214 detects no original, it is judged that the original on the original supporting table 831' has become exhausted, and the original supporting table 831 is returned to its lowermost position, thus completing the operation.

While in the present embodiment, the adjustment of the amounts of movement of the leading end side and the trailing end side of the original is effected by the pitches P and p of the feed screw, the gear ratio of the gears intervening in the course from the motor 821 may be changed to thereby change the amount of rotation of the feed screw of the same pitch between the leading end side and the trailing end side, thus changing the amount of movement of the original supporting table 831.

Also, actuator means such as independent motors may be provided on the leading end side shaft 823 and the trailing end side shaft 824.

By the original supporting portion lOOB having such a construction and operation, it has become possible to provide an image reading apparatus which suppresses the variation in the angle of inclination of the fed original and which has both of the operability when an original supporting portion of the fixed pivot type is used and a practically sufficient sheet feeding capacity, with a compact apparatus size.

Also, by the provision of a plurality of operating means for making the leading end portion and the trailing end portion movable independently of each other and movement amount changing means for making the amounts of movement by the respective operating means changeable independently of each other, it becomes possible to change the setting of H1, h1, H2, h2, M, m, etc. easily by controlling each operating means, and it becomes possible to locate a sheet material at a sheet feeding position in an optimum state with the kind and size of the fed sheet material and the operability or the like taken into account.

That is, for sheet materials of small sizes, it becomes possible to incline the original supporting table 831 always at a predetermined angle irrespective of its lowermost position or its uppermost position, and the handling property and the stability of feeding thereof (the ease with which the sheet materials are piled and the maintenance of the state of the piled sheet materials) can be improved.

<Sixth Embodiment>

Figure 12:
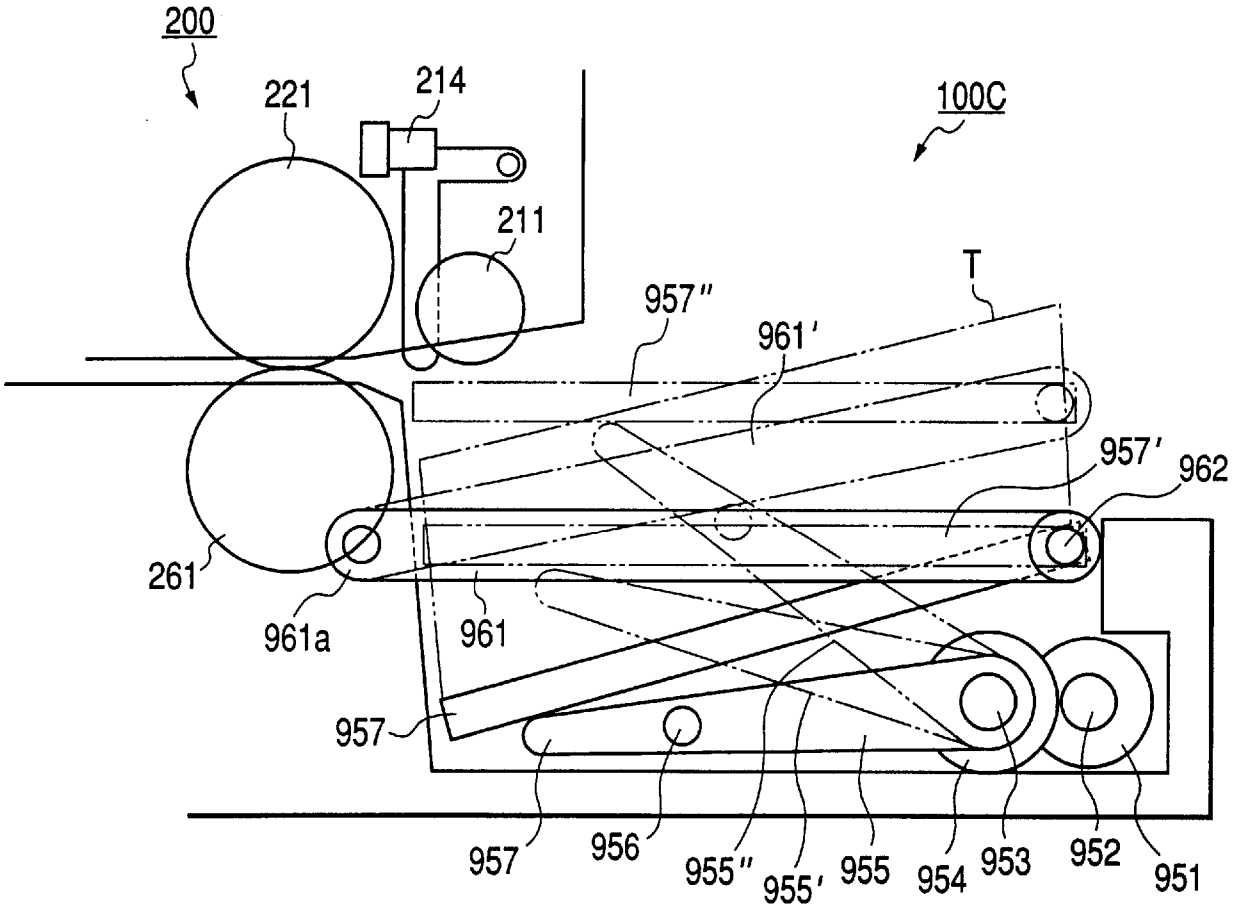
FIG. 12 is an illustration of the cross-sectional construction of an original supporting portion in a sixth embodiment of the present invention.

FIG. 12 is an illustration of the cross-sectional construction of a sixth embodiment of the original supporting portion 100C of an image reading apparatus to which the present invention is applied. The construction of the sheet feeding portion 200 and subsequent portions is similar to that in the fourth and fifth embodiments and therefore need not be described. Also, the operating conditions of the original supporting table 957 of the sheet feeding portion 200 are basically similar to those in the fourth and fifth embodiments.

In FIG. 12, the reference numeral 951 designates a motor as an operation actuator for the original supporting portion 100C, the reference numeral 952 denotes a gear mounted on a motor shaft, the reference numeral 953 designates a shaft to which a gear 954 and a push-up arm 955 as operating means disposed under the original supporting table 957 are secured, and the reference numeral 956 denotes a boss provided on the push-up arm 955.

The reference numeral 961 designates a pivot arm as a connecting member having the rear end side pivot 962 of the original supporting table 957 on one end portion thereof, and the other end portion thereof is rotatably held on an apparatus body.

In this embodiment, the original supporting table 957 indicated by solid line is in its lowermost position, and in this state, a bundle of originals T are piled thereon. When the conveyance of the original is started, the motor 951 is rotated and the push-up arm 955 connected by the gear begins to move. At this point of time, the fore end portion as a first bearing portion of the push-up arm 955 bears against the fore end side (the side opposite to the pivot 962) of the original supporting table 957 to thereby move up the original supporting table 957 by the pivotal movement about the pivot 962.

When it is detected by the detecting means 214 that the uppermost one of the piled bundle of originals T has reached a prescribed level, the motor 951 is stopped and the originals are conveyed one by one as in the fourth embodiment.

With a decrease in the originals, the original supporting table 957 is moved up, and when it has reached the position of the original supporting table 957', the boss 956 provided on the push-up arm 955 bears against the underside of the pivot arm 961.

The boss 956 provides a second bearing portion nearer to the shaft 953 which is the center of pivotal movement than the fore end portion as the first bearing portion, and moves the pivot arm 961 with an amount of movement smaller than the amount of movement of the fore end portion.

Thereafter, the operation of the boss 956 pushing up the pivot arm 961 is added and therefore, the operations of the fore end of the original supporting table 957 by the push-up arm 955 and the rear end of the original supporting table 957 by the pivot arm 961 take place and finally, the original supporting table 957 reaches its uppermost position indicated by 957", and this is detected by detecting means, not shown.

If at this time, the detecting means 214 detects no original, it is judged that the originals on the original supporting table have become exhausted, and the original supporting table 957" is returned to its lowermost position, thus completing the operation.

By the original supporting portion 100C having such a construction and operation, it has become possible to provide an image reading apparatus which suppresses the variation in the angle of inclination of the fed originals and which has both of the operability when an original supporting portion of the fixed pivot type is used and a practically sufficient sheet feeding capacity, with a compact apparatus size.

As described in the above embodiments of the present invention, it becomes possible to provide a sheet feeding apparatus in which a sheet material supporting portion is operated to thereby suppress the variation in the angle of inclination of fed originals and which has all of a stable feeding characteristic, the good operability when an original supporting portion of the fixed pivot type is used and a practically sufficient sheet feeding capacity, and a sheet material processing apparatus provided with such sheet feeding apparatus, with a compact apparatus size.

Also, by the provision of a plurality of operating means for making the fore end portion and the rear end portion movable independently of each other, it becomes possible to arbitrarily set the positions and the amounts of movement of the fore end portion and the rear end portion, and it becomes possible to make the handling property (operability) for sheet materials by the operator and the sheet feeding and conveying property more suitably compatible.

Also, by the provision of movement amount changing means capable of changing the amounts of movement by respective operating means independently of one another, it becomes possible to control the respective operating means to thereby change the setting of H1, h1, H2, h2, m, m, etc. easily, and it becomes readily possible to locate a sheet material at a sheet feeding position in an optimum state with the kind and size of a sheet to be fed and operability or the like taken into account.

What is claimed is:

1. A sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between both said rotatable members, said sheet feeding apparatus comprising:

inter-shaft distance changing means for at least one of both said rotatable members to change the inter-shaft distance thereof relative to the other rotatable member;

sheet detecting means provided near both said rotatable members for detecting the passage of the sheets; and means for controlling so that with the start of feeding, at least one of both said rotatable members may start the operation of spacing its inter-shaft distance relative to the other rotatable member, and when a sheet is detected by said sheet detecting means, the operation of spacing said inter-shaft distance may be stopped, and when the feeding of said sheet is completed, at least one of both said rotatable members may bring the inter-shaft distance thereof relative to the other rotatable member close to a position in which feeding is impossible.

2. A sheet feeding apparatus according to claim 1, wherein said sheet feeding rotatable member and said sheet separating rotatable member are rollers, and the rotary shafts of said rollers are substantially parallel to each other and formed with comb-tooth-like grooves on the outer peripheral portions thereof, and have a shape in which the concave surfaces and convex surfaces of the grooves are in non-contact with each other and can overlap each other axially thereof.

3. A sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between both said rotatable members, said sheet feeding apparatus comprising:

inter-shaft distance changing means for at least one of both said rotatable members to change the inter-shaft distance thereof relative to the other rotatable member;

sheet detecting means provided near both said rotatable members, for detecting the passage of the sheets; and means for controlling so that with the start of feeding, at least one of both said rotatable member may start the operation of spacing its inter-shaft distance relative to the other rotatable member, and may stop the operation of spacing said inter-shaft distance after the operation of spacing said inter-shaft distance has performed by a predetermined amount from a point of time at which a sheet has been detected by said sheet detecting means, and when the feeding of said sheet is completed, at least one of both said rotatable members may perform the operation of bringing the inter-shaft distance thereof relative to the other rotatable member close to a position in which feeding is impossible, for each sheet fed.

4. A sheet feeding apparatus according to claim 3, wherein said sheet feeding rotatable member and said sheet separating rotatable member are rollers, and the rotary shafts of said rollers are substantially parallel to each other and formed with comb-tooth-like grooves on the outer peripheral portions thereof, and have a shape in which the concave surfaces and convex surfaces of the grooves are in non-contact with each other and can overlap each other axially thereof.

5. A sheet feeding apparatus according to any one of claims 1 to 4, wherein said feeding rotatable member and said sheet separating rotatable member are in a state in which they hamper the feeding of the sheets before the feeding of the sheets is started or after the inter-shaft distance has been brought close.

6. A sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between both said rotatable members, said sheet feeding apparatus comprising;

inter-shaft distance changing means for at least one of both said rotatable members to change the inter-shaft distance thereof relative to the other rotatable member;

sheet detecting means provided downstream of the axially most proximate portions of both said rotatable members with respect to the direction of sheet conveyance; and means for controlling so that with the start of feeding, at least one of both said rotatable members may start the operation of spacing its inter-shaft distance relative to the other rotatable member, and when the passage of a sheet through the most proximate portions of both said rotatable members is detected by said sheet detecting means, the operation of spacing said inter-shaft distance may be stopped, and the operation of at least one of both said rotatable members bringing the inter-shaft distance thereof relative to the other rotatable member close to a position in which feeding is impossible, on the basis of the sheet non-detection of said sheet detecting means, may be performed for each sheet fed.

7. A sheet feeding apparatus according to claim 6, wherein said sheet feeding rotatable member and said sheet separating rotatable member are rollers, and the rotary shafts of said rollers are substantially parallel to each other and formed with comb-tooth-like grooves on the outer peripheral portions thereof, and have a shape in which the concave surfaces and convex surfaces of the grooves are in non-contact with each other and can overlap each other axially thereof.

8. A sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other and rotated at the opposed portion, and separating and conveying sheets one by one between both said rotatable members, said sheet feeding apparatus comprising:

inter-shaft distance changing means for at least one of both said rotatable members to change the inter-shaft distance thereof relative to the other rotatable member;

sheet detecting means provided downstream of the axially most proximate portions of both said rotatable members with respect to the direction of sheet conveyance; and means for controlling so that with the start of feeding, at least one of both said rotatable members may start the operation of spacing its inter-shaft distance relative to the other rotatable member, and when the passage of a sheet through said most proximate portions is detected by said sheet detecting means, the operation of spacing said inter-shaft distance may be stopped after the operation of spacing said inter-shaft distance by a predetermined amount has been performed from the point of time of the detection, and the operation of at least one of both said rotatable members bringing the inter-shaft distance relative to the other rotatable member close to a position in which sheet feeding is impossible, on the basis of the sheet non-detection of said sheet detecting means, may be performed for each sheet fed.

9. A sheet feeding apparatus according to claim 8, wherein said sheet feeding rotatable member and said sheet separating rotatable member are rollers, and the rotary shafts of said rollers are substantially parallel to each other and formed with comb-tooth-like grooves on the outer peripheral portions thereof, and have a shape in which the concave surfaces and convex surfaces of the grooves are in non-contact with each other and can overlap each other axially thereof.

10. A sheet feeding apparatus according to any one of claims 6 to 9, wherein said sheet feeding rotatable member and said sheet separating rotatable member are in a state in which they hamper the feeding of the sheets before the feeding of the sheets is started or after the inter-shaft distance has been brought close.

11. A sheet processing apparatus having:

a supporting portion supporting a bundle of sheets thereon;

a feeding rotatable member rotated in a direction to feed the sheets fed from said supporting portion;

a separating rotatable member disposed in opposed relationship with said feeding rotatable member and rotated in a direction opposed to said feeding direction;

first sheet detecting means disposed near the sheet entrance of both said rotatable members;

second sheet detecting means disposed near the sheet exit of both said rotatable members;

changing means for moving the rotary shafts of both said rotatable members toward and away from each other to thereby change the distance between both said rotatable members;

means for controlling said changing means so that the rotary shafts of said rotatable members may be moved in a direction to widen the spacing therebetween by the sheet detection of said first sheet detecting means, and then the movement of the rotary shafts of both said rotatable members may be stopped at a predetermined position by the sheet detection of said second sheet detecting means; and processing means for processing the sheets fed by said feeding rotatable member.

12. A sheet processing apparatus according to claim 11, wherein said control means controls so that when said second sheet detecting means has come to detect no sheet after it has detected the sheet, the rotary shafts of both said rotatable members may be moved in a direction to narrow the spacing therebetween, and when the spacing has reached a set spacing, the movement may be stopped.

13. A sheet processing apparatus according to claim 11, wherein said control means performs the operation of controlling said spacing each time a sheet is fed.

14. A sheet processing apparatus according to claim 11, wherein said feeding rotatable member has large-diametered portions and small-diametered portions alternately in the axial direction of the rotary shaft thereof, said separating rotatable member has large-diametered portions and small-diametered portions alternately in the axial direction of the rotary shaft thereof, and both said rotatable members are disposed so that the large-diametered portions and the small-diametered portions thereof may be opposed to each other.

15. A sheet processing apparatus according to claim 14, wherein both said rotatable members are disposed with the large-diametered portions thereof overlapping each other so that the large-diametered portions of one of both said rotatable members may come into the small-diametered portions of the other rotatable member.

16. A sheet processing apparatus according to claim 14, wherein said processing means includes means for reading images on the sheets.

17. A sheet feeding apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other, and separating and conveying sheets one by one between both said rotatable members, said sheet feeding apparatus comprising:

shaft distance changing means for changing a distance between a shaft of said sheet feeding rotatable member and a shaft of said sheet separating rotatable member;

sheet detecting means for detecting the sheet conveyed by both said rotatable members; and means for controlling the shaft distance changing means so that with the start of feeding, the distance of the shafts of both said rotatable members is widened from a close condition in which sheet feeding is impossible, and the operation of said shaft distance changing means is stopped according to detection of a sheet passed between said rotatable members by said sheet detecting means, and when the feeding of said sheet is completed, said shaft distance changing means returns the shaft of both said rotatable members to the close condition.

18. A sheet feeding apparatus according to claim 17, wherein said shaft changing means moves at least one of both said rotatable members.

19. A sheet feeding apparatus according to claim 18, wherein each of said sheet feeding rotatable member and said sheet separating rotatable member have the shaft and a roller, and said rollers formed with comb-tooth-like grooves on the outer peripheral portions thereof, and have a shape in which the concave surface and convex surface of the grooves are in non-contact with each other and can overlap each other axially thereof.

20. A sheet feeding apparatus according to claim 19, wherein said feeding rotatable member and said sheet separating rotatable member are in a state in which they regulates a leading end of the sheet when the feeding of the sheet starts.

21. A sheet feeding apparatus according to claim 17, wherein said sheet detecting means is a sensor disposed downstream of said rotatable members and said controlling means controls said shaft distance changing means so as to stop the movement of said shafts according to the detection of the sheet by said sensor.

22. A sheet feeding apparatus according to claim 21, wherein said controlling means controls said shaft distance changing means so as to return the shafts to the close condition according to detection of the sheet by said sensor.

23. A sheet feeding apparatus according to claim 17, further comprising sheet supporting means for supporting the sheets and sheet supply means for feeding out the sheet from said sheet supporting means, wherein said sheet detecting means has a first sensor disposed downstream of said rotatable members and a second sensor disposed upstream of said rotatable members and said controlling means controls said shaft distance changing means so as to start to widen the distance of said shafts according to the detection of the sheet by said second sensor and to stop the movement of said shafts according to the detection of the sheet by said first sensor.

24. A sheet feeding apparatus according to claim 23, wherein said controlling means controls said shaft distance changing means so as to return the shaft to the close condition according to detection of the sheet by said first sensor.

25. A sheet processing apparatus having a sheet feeding rotatable member rotated in a forward feeding direction and a sheet separating rotatable member rotated in a reverse feeding direction, said sheet feeding rotatable member and said sheet separating rotatable member being disposed in opposed relationship with each other, and separating and conveying sheets one by one between both said rotatable members, said sheet processing apparatus comprising:

shaft distance changing means for changing a distance between a shaft of said sheet feeding rotatable member and a shaft of said sheet separating rotatable member;

sheet detecting means for detecting the sheet conveyed by both said rotatable members;

means for controlling the shaft distance changing means so that with the start of feeding, the distance of the shafts of both said rotatable members is widened from a close condition in which sheet feeding is impossible, and the operation of said shaft distance changing means is stopped according to detection of a sheet passed between said rotatable members by said sheet detecting means, and when the feeding of said sheet is completed, said shaft distance changing means returns the shaft of both said rotatable members to the close condition; and processing means for processing the sheets fed by said rotatable members.

* * * * *

UNITED STATES PATENT AND TRADEMARK OFFICE

CERTIFICATE OF CORRECTION

PATENT NO. : 6,168,146 B1 
DATED : January 2, 2001
INVENTOR(S) : Hiroshi Komuro et al.

It is certified that error appears in the above-identified patent and that said Letters Patent is hereby corrected as shown below:

Title page,
Item [57], ABSTRACT,
Line 1, "a pair of feeding roller and" should read -- a feeding roller and a separating roller, and --.
Line 2, "separating roller" should be deleted.

Column 2,
Line 62, "can" should read -- cam --.

Column 5,
Line 26, "cam" should read -- can --.

Column 7,
Lines 45, 49 and 56, "pair of" should be deleted.

Column 8,
Line 1, "pair of" should be deleted.
Line 43, "pair" should be deleted.
Line 44, "of" should be deleted.

Column 13,
Line 44, "receives" should read -- receive --.

Column 14,
Line 35, "then" should read -- them --.

Column 18,
Line 40, "m, m," should read -- M, m, --.

Column 19,
Line 32, "has" should read -- has been --.

UNITED STATES PATENT AND TRADEMARK OFFICE

CERTIFICATE OF CORRECTION

PATENT NO. : 6,168,146 B1
DATED : January 2, 2001
INVENTOR(S) : Hiroshi Komuro et al.

It is certified that error appears in the above-identified patent and that said Letters Patent is hereby corrected as shown below:

Column 22,
Line 30, "regulates" should read -- regulate --.

Signed and Sealed this

First Day of April, 2003

JAMES E. ROGAN
*Director of the United States Patent and Trademark Office*